US007136601B2

(12) United States Patent
Akizuki et al.

(10) Patent No.: US 7,136,601 B2
(45) Date of Patent: Nov. 14, 2006

(54) FIXING APPARATUS AND IMAGE FORMING APPARATUS WITH TEMPERATURE CONTROLLER INCREASING ELECTRIC POWER SUBSTANTIALLY AT A TIMING WITH TEMPERATURE DEGRADATION

(75) Inventors: Tomoo Akizuki, Shizuoka (JP); Masao Umezawa, Shizuoka (JP); Atsutoshi Ando, Kanagawa (JP); Toshikazu Tsuchiya, Shizuoka (JP); Hisahiro Saito, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 20 days.

(21) Appl. No.: 10/463,528

(22) Filed: Jun. 18, 2003

(65) Prior Publication Data

US 2004/0033084 A1 Feb. 19, 2004

(30) Foreign Application Priority Data

Jun. 21, 2002 (JP) ..... 2002-180842

(51) Int. Cl.
*G03G 15/20* (2006.01)

(52) U.S. Cl. ..... 399/69; 219/216

(58) Field of Classification Search ..... 399/67–70, 399/328–331, 334–335
See application file for complete search history.

(56) References Cited

U.S. PATENT DOCUMENTS 5,787,321 A * 7/1998 Nishikawa et al. ..... 399/69
5,899,599 A 5/1999 Kato ..... 399/69
6,185,383 B1 * 2/2001 Kanari et al. ..... 399/45
6,347,201 B1 2/2002 Sano et al. ..... 399/67
6,405,000 B1 * 6/2002 Nakaya ..... 399/67
6,430,386 B1 8/2002 Okubo et al. ..... 399/328
6,438,335 B1 * 8/2002 Kinouchi et al. ..... 399/67
6,438,349 B1 8/2002 Ando ..... 399/333
6,519,426 B1 * 2/2003 Goto et al. ..... 399/69

FOREIGN PATENT DOCUMENTS

JP 10-78727 3/1998
JP 11-15303 1/1999

* cited by examiner

*Primary Examiner*—Robert Beatty
(74) *Attorney, Agent, or Firm*—Fitzpatrick, Cella, Harper & Scinto

(57) ABSTRACT

In a fixing apparatus using a fixing belt having an elastic layer as a fixing member and an image forming apparatus mounting such a fixing apparatus thereto, before a temperature detecting unit detects temperature change caused upon recording material conveying into a nip region, an electric power required to be applied to a heating element to heat the heating element is corrected to a predetermined electric power, and, when the fixing apparatus is started-up upon starting of print, at a predetermined timing, the electric power required to be applied to the heating element to heat the heating element is corrected to the predetermined electric power and a value of the predetermined electric power is substantially the same as an electric power value required for reaching the fixing apparatus to the predetermined power. The value of the predetermined power is determined in accordance with heat capacity of the recording material or a heat accumulating degree of the fixing apparatus on demand.

36 Claims, 17 Drawing Sheets

FIXING APPARATUS AND IMAGE FORMING APPARATUS WITH TEMPERATURE CONTROLLER INCREASING ELECTRIC POWER SUBSTANTIALLY AT A TIMING WITH TEMPERATURE DEGRADATION

BACKGROUND OF THE INVENTION

1. Field of the Invention

The present invention relates to a fixing apparatus and an image forming apparatus.

More specifically, the present invention relates to a fixing apparatus comprising, at least, a heating element, an electric power supplying portion (heating means) for supplying an electric power to the heating element, at least one or more temperature detecting means, a first rotary member shifted together with a recording material and a second rotary member for cooperating with the recording material to define an abutment portion therebetween and wherein a temperature of the first rotary member is controlled by performing feedback control of the electric power supplied from the electric power supplying portion to the heating element on the basis of a temperature detected by the temperature detecting means and the recording material bearing an image is nipped and conveyed at the abutment portion thereby to heat the recording material, and an image forming apparatus, for example, such as an electro-photographic copier, printer, facsimile and the like, having such a fixing apparatus.

2. Related Background Art

In recent years, colorization in an image forming apparatus such as a printer, a copier and the like has been progressed. As a fixing apparatus used in such an image forming apparatus, a fixing apparatus of heat roller type including a fixing member having an elastic layer is well known.

However, in the fixing apparatus of heat roller type having the elastic layer, there was a problem that a heat capacity of the heat roller itself becomes great and a time (warm-up time) required for increasing a temperature of a fixing roller up to a temperature suitable for toner image fixing becomes long, and, further, the cost of the fixing apparatus was increased.

As a fixing apparatus having short warm-up time, a fixing apparatus of belt fixing time widely used in a monochromatic image forming apparatus is well known. A schematic constructional view showing one example of such a fixing apparatus is illustrated in FIG. 24.

The fixing apparatus is generally designated by the reference numeral 201. A fixing belt unit 202 is an assembly comprising a heat folder 207 having a half circular bucket-shaped cross-section, a fixing heater 204 secured to a lower surface of the heater holder 207 along a longitudinal direction of the heater holder (perpendicular to the plane of FIG. 24) and a fixing belt 203 having an endless thin layer and loosely mounted around the heater holder 207 having the fixing heater.

An elastic pressurizing roller 205 has metal core both ends of which are rotatably supported between side plates of the fixing apparatus.

The fixing belt unit 202 is disposed on the elastic pressurizing roller 205 in parallel with the pressurizing roller 205 with the fixing heater 204 facing downwardly, and both ends of the heater holder, 207 are pushed upwardly with a predetermined urging force by means of biasing means (not shown). With this arrangement, a fixing nip portion 206 having a predetermined width is formed by abutting a lower surface of the fixing heater 204 against an upper surface of the elastic pressurizing roller 205 with the interposition of the fixing belt 203 in opposition to elasticity of the pressurizing roller.

The elastic pressurizing roller 205 is rotatingly driven at a predetermined peripheral speed by means of a driving mechanism (not shown) in a direction shown by the arrow. By such rotation of the elastic pressurizing roller 205, a rotational force is applied to the fixing belt 203 at the fixing nip portion 206 by a friction force between the elastic pressurizing roller 205 and an outer peripheral surface of the fixing belt 203, with the fixing belt 203 is rotatingly driven around the heater holder 207 at a peripheral speed substantially corresponding to the peripheral speed of the elastic pressurizing roller 205 in a direction shown by the arrow in a condition that an inner surface of the fixing belt is closely contacted with and slid on the lower surface of the fixing heater 204 at the fixing nip portion 206.

The fixing belt 203 is constituted by a heat-resistive resin endless belt having a thickness of about 50 μm and a mold releasing layer (coating layer made of fluoro-resin or the like) formed on the endless belt and having a thickness of 10 μm. Further, in order to reduce a heat capacity of the fixing belt 203, any elastic layer is not provided on the fixing belt 203.

The fixing heater 204 is constituted by a resistive heating element formed on a ceramic substrate. Temperature detecting means 209 is contacted with a rear surface of the fixing heater 204 to detect a temperature of the fixing heater 204, and temperature control is performed by means of control means (not shown) by controlling an electric power supplied to the fixing heater 204 so that the temperature of the fixing heater 204 becomes a desired temperature.

In a condition that the elastic pressurizing roller 205 is rotatingly driven and the fixing belt 203 is rotatingly driven and the fixing heater 204 is started-up to the predetermined temperature to be subjected to the temperature control, a recording material P bearing a unfixed toner image t is introduced between the fixing belt 203 and the elastic pressurizing roller 205 at the fixing nip portion 206. The recording material P together with the fixing belt 203 is pinched and conveyed at the fixing nip portion 206 while closely contacting a surface of the recording material bearing the unfixed toner image with the outer surface of the fixing belt 203. During such pinching and conveyance, heat from the fixing heater 204 is applied to the recording material P via the fixing belt 203 and the recording material is subjected to pressure from the fixing nip portion 206, with the result that the unfixed toner image t is fixed onto the recording material P by heat and pressure as a permanent fixed image. After passed through the fixing nip portion 206, the recording material P is self-stripped from the surface of the fixing belt 203 by curvature and then is discharged.

In the fixing apparatus 201 having the above-mentioned construction, since the heat capacity of the fixing belt 203 is very small, after the electric power is applied to the fixing heater 204, the temperature of the fixing nip portion 206 can be increased, for a short time, up to a temperature capable of fixing the toner image.

However, in a case where the belt type fixing apparatus 201 using the fixing belt 203 having no elastic layer is used as a fixing apparatus of a color image forming apparatus, since the fixing belt 203 as the fixing member has no elastic layer, the surface of the fixing belt 203 cannot follow unevenness of the surface of the recording material, unevenness caused by presence/absence of the toner layer and unevenness of the toner layer itself, thereby causing difference in heat amount supplied from the fixing belt 203 between the recessed portions and the protruded portions. In the protruded portions adequately contacted with the fixing belt 203, since the heat from the fixing belt 203 is well transferred, the great heat amount is given; while, in the recessed portions which are not contacted with the fixing belt 203 so well, since the heat from the fixing belt 203 is hard to be transferred in comparison with the protruded portions, given heat amount is small. As such, since the heat amount is differentiated due to the unevenness of the toner layer, a fusing condition of the toner becomes uneven, thereby generating gloss irregularity, which affects an influence upon the fixed image.

Particularly, in the color image, since plural color toner images are overlapped and color-mixed, the unevenness of the toner layer is greater in comparison with the monochromatic image, and, thus, in the case where the fixing belt 203 has no elastic layer, gloss irregularity of the fixed image becomes greater, thereby worsening image quality. Further, in a case where the recording material P is an OHP sheet, when the fixed image is projected, light scattering is generated due to the fact that the surface of the fixed image is not microscopically uniform, thereby resulting in reduction in permeability.

Although it can be considered that the fixing belt 203 having no elastic layer is used and silicone oil is coated on the fixing belt 203 so that the heat is well transferred onto the unevenness of the recording material P and the unfixed toner image t, there were problems that the cost is increased and that the fixed image and the recording material P are contaminated by oil.

To avoid this, a fixing apparatus constituting a low cost color on demand fixing apparatus by using a fixing belt having an elastic layer in a belt fixing apparatus has been proposed (for example, refer to Japanese Patent Application Laid-Open No. 11-15303).

FIG. 25 is a schematic constructional view of a belt fixing apparatus using a fixing belt 203 having an elastic layer as a fixing member. Constructional members and parts common to those in FIG. 24 are designated by the same reference numerals and explanation thereof will be omitted.

In a case where this fixing apparatus is used, since heat transfer characteristics of silicone rubber used in the elastic layer of the fixing belt 203 is small, temperature response of the fixing belt 203 is bad and an increasing speed of a temperature of a fixing sleeve is very slow in comparison with the temperature increasing speed of the fixing heater 204. Further, a difference between the temperature of the fixing heater 204 and the temperature of the fixing belt 203 reaches several tens of ° C. at the maximum, and, such temperature difference is greatly differentiated between idle-rotation and sheet passing. Thus, as is in conventional cases, in a system in which the temperature detecting element 209 is disposed on the rear surface of the fixing heater 204, it was very difficult to control the temperature of the fixing belt 203.

To avoid this, in the apparatus shown in FIG. 25, the temperature detecting element 209 is disposed on the inner surface or front surface of the fixing belt 203 rather than the fixing heater 204 to detect the temperature of the fixing belt 203 itself and the temperature control of the fixing belt 203 is performed by controlling the temperature of the fixing heater 204 by feedback control such as PID control.

By using such a construction, the temperature of the fixing belt 203 can be controlled more accurately.

However, as a result that a fixing operation was performed by using this fixing apparatus, the following two problems occurred.

(1) Problem 1

From a condition that constant temperature control is performed to stabilize the temperature, when the recording material P is passed, immediately after the recording material P rushes into the fixing nip portion 206, the temperature of the fixing belt 203 is decreased abruptly, and, thereafter, although the temperature is increased, overshoot is generated, thereby resulting in great temperature fluctuation.

This phenomenon will now be explained.

In the conventional fixing apparatus, after PID control is continued in an idle rotation condition, the recording material P is passed. In this case, as shown in FIG. 5, immediately after the recording material P conveys into the fixing nip portion 206, the temperature of the inner surface of the fixing belt 203 is decreased abruptly, and, thereafter, although the temperature is increased, overshoot is generated. Concretely, as shown in FIG. 5, in the idle rotation before the sheet passing, although the temperature of the inner surface of the fixing sleeve 203 is stabilized, immediately after the recording material P conveys into the fixing nip portion 206, it takes about 10 seconds until the temperature of the inner surface of the fixing belt 203 is decreased up to a temperature lower than a target temperature by about 10° C. and then is increased up to a temperature greater than the target temperature by about 7° C. and then is stabilized. During a period from immediately after the recording material P conveys into the fixing nip portion 206 to when the temperature of the inner surface of the fixing sleeve 203 is stabilized, temperature ripple (difference between a maximum temperature value and a minimum temperature value within a given time) was about 17° C. In subsequent continuous sheet passing, stable temperature control (temperature ripple of about 60° C.) was achieved.

In the condition that the temperature of the inner surface of the fixing sleeve 203 is stabilized during the idle rotation, the electric power being applied to the fixing heater 204 is about 80 W, and in the condition that the temperature of the inner surface of the fixing sleeve 203 is stabilized in the subsequent continuous sheet passing, the electric power being applied to the fixing heater 204 is about 300 W which is substantially constant.

On the other hand, immediately after the recording material P conveys into the fixing nip portion 206, behavior that the electric power is increased up to about 500 W due to the temperature reduction and fluctuates by about 20 seconds and then is stabilized at about 300 W was indicated. This phenomenon could not be solved even when each gain in the PID control is adjusted, and it was difficult suppress the temperature fluctuation for more.

In this way, when the temperature fluctuation of about 17° C. is generated, in a color image forming apparatus of electro-photographic type used in the test, the fixing abilities of the outputted prints were greatly dispersed and gloss properties were greatly changed thereby to worsen image quality. Furthermore, depending upon the recording material and/or printing pattern, poor fixing occurred due to great temperature fluctuation.

Further, this phenomenon became more and more conspicuous as a process speed was increased, and, in the measurement of FIG. , although the process speed was 87 mm/sec, when the process speed was 190 mm/sec, the temperature of the inner surface of the fixing belt 203 was decreased to a value lower than the target temperature by about 20° C. immediately after the recording material P conveys into the fixing nip portion 206, and thereafter, the temperature was increased to a value greater than the target temperature by about 8° C. to provide temperature nipple of about 28° C. In this case, the fluctuation range of the gloss property is further increased and partial poor fixing is also worsened.

(2) Problem 2

In the start-up, the overshoot is great. Further, in the start-up, the temperature nipple is great, and, after the start-up and upon the recording material rushing, dispersion of temperature becomes great.

This phenomenon will now be explained.

In this fixing apparatus, start-up temperature control sequence is constituted by the following two steps a and b.

a. "start-up ((fix) electric power control"; and b. "PID control"

The "start-up electric power control" in the step a is control in which a constant electric power is applied in order to quickly start-up the temperature of the fixing apparatus and to ensure on-demand, and, in this example, the electric power of 1000 W is applied to the fixing heater 204. In this case, the fixing belt 203 is heated by the fixing heater 204 while being driven by the rotation of the pressurizing roller 205. When the detection temperature of the temperature detecting means 209 reaches a predetermined temperature (target temperature of −20° C.: thus, for example, when the target temperature is 190° C., 190° C.−20° C.=170° C.), the sequence goes to the "PID control" in the step b, where the electric power applied to the fixing heater 204 is controlled the temperature of the rear surface of the fixing belt 203 approaches the target temperature by means of the PID control.

When the above controls are used, as shown in FIG. 21, the overshoot is generated and the temperature ripple due to the overshoot becomes great.

If the overshoot and the temperature ripple become great in the start-up, the following two problems will occur.

I. If operations at the high temperature due to the overshoot in the start-up are repeated, damage on various parts of the fixing apparatus becomes great, thereby shortening a service life of the fixing apparatus.

II. Since the temperature nipple is great in the start-up, at the moment when the recording material P enters into the nip portion, the temperature is not stabilized, and, since the temperature fluctuation becomes great while the recording material P is passing through the fixing nip portion 206, gloss fluctuation in each outputted print becomes great, which results in an unfavorable image. Further, in dependence upon the kind of the recording material P and/or printing pattern, poor fixing will occur at areas where the temperature is decreased.

On the other hand, it is possible to suppress the overshoot more or less by starting-up the temperature gently with a small electric power. In this case, however, it takes a long term until the fixing apparatus is started-up to the predetermined temperature, thereby worsening the on-demand property.

In this way, when the conventional fixing apparatus controlling method is used, there is a trade-off relationship between the on-demand property and the stability of the temperature control.

The Inventors zealously investigated such a phenomenon and, it was found that these problems are generated by the following two reasons:

1) Since heat transfer characteristics of the silicone rubber used in the elastic layer of the fixing belt 203 is small and the heat capacity is great, response is worsened during a period from when the electric power is applied to the fixing heater 204 and to when the temperature of the fixing belt 203 is increased.

2) Since the position of the temperature detecting element 209 for detecting the temperature of the rear surface of the fixing belt 203 is spaced apart from the fixing heater 204 as the heating member, detection timing is delayed.

That is to say, in the feedback control as represented by the PID control, since change in the control amount is detected and an operating amount corresponding thereto is added, if the temperature control tries to be performed on the basis of the PID control, time lag due to the above two reasons 1) and 2) becomes great, and, if the change in temperature is great as is in the start-up and the recording material P rushing, even when the detection result of the temperature detecting element 209 is reflected upon the electric power control, since the actual temperatures of the fixing heater 204 and the fixing nip portion 206 have already different values, correct temperature control cannot be achieved, with the result that the overshoot and hunting (temperature ripple) are apt to occur.

SUMMARY OF THE INVENTION

The present invention is made in consideration of the above-mentioned problems, and an object of the present invention is to provide a fixing apparatus in which, even when a fixing belt having an elastic layer is used as a fixing member in the fixing apparatus, a service life of the fixing apparatus is long and in which correct temperature control of the fixing member can be performed to provide good fixing ability and, if the fixing temperature control temperature is improper, a poor image is not generated, and a high quality image having no unevenness in printing quality such as gloss can be obtained, and an image forming apparatus to which such a fixing apparatus is mounted.

The present invention provides the following fixing apparatus, and an image forming apparatus.

A fixing apparatus comprising, at least, a heating element, an electric power supplying portion for supplying an electric power to the heating element, at least one or more temperature detecting means, a first rotary member shifted together with a recording material and a second rotary member for cooperating with the recording material to define an abutment portion therebetween and wherein a temperature of the first rotary member is controlled by performing feedback control of the electric power supplied from the electric power supplying portion to the heating element on the basis of a temperature detected by the temperature detecting means and the recording material bearing an image is nipped and conveyed at the abutment portion thereby to heat the recording material and further wherein, before the temperature detecting means detect temperature change caused when the recording material rushes into the abutment portion, an electric power supplied to the heating element and required for heating the heating element is corrected to a predetermined electric power.

With this arrangement, since overshoot and temperature ripple are suppressed, a service life of the fixing apparatus can be extended, and, correct temperature control of the fixing member is performed to provide good fixing ability and, if the fixing temperature control temperature is improper, a poor image is not generated, and a high quality image having no unevenness in printing quality such as gloss can be obtained.

According to the present invention, there are provided a fixing apparatus in which, even when the fixing belt having the elastic layer is used as the fixing member in the fixing apparatus, the correct temperature control of the fixing member is performed to obtain the high quality image having no unevenness in printing quality such as gloss, and which has high durability and long service life, and an image forming apparatus to which such a fixing apparatus is mounted.

DETAIELD DESCRIPTION OF THE PREFERRED EMBODIMENTS

The present invention will now be explained with reference to embodiments thereof.

Hereinafter, preferred embodiments of the present invention will be fully explained with reference to the accompanying drawings. However, sizes, materials, configurations and relative positional relationships of constructional parts or elements described in the embodiments may be appropriately changed in accordance with constructions and/or various conditions of apparatuses to which the present invention is applied, and it is not intended that the present invention is limited to such embodiments.

<First Embodiment>

(1) Example of Image Forming Apparatus

Figure 1:
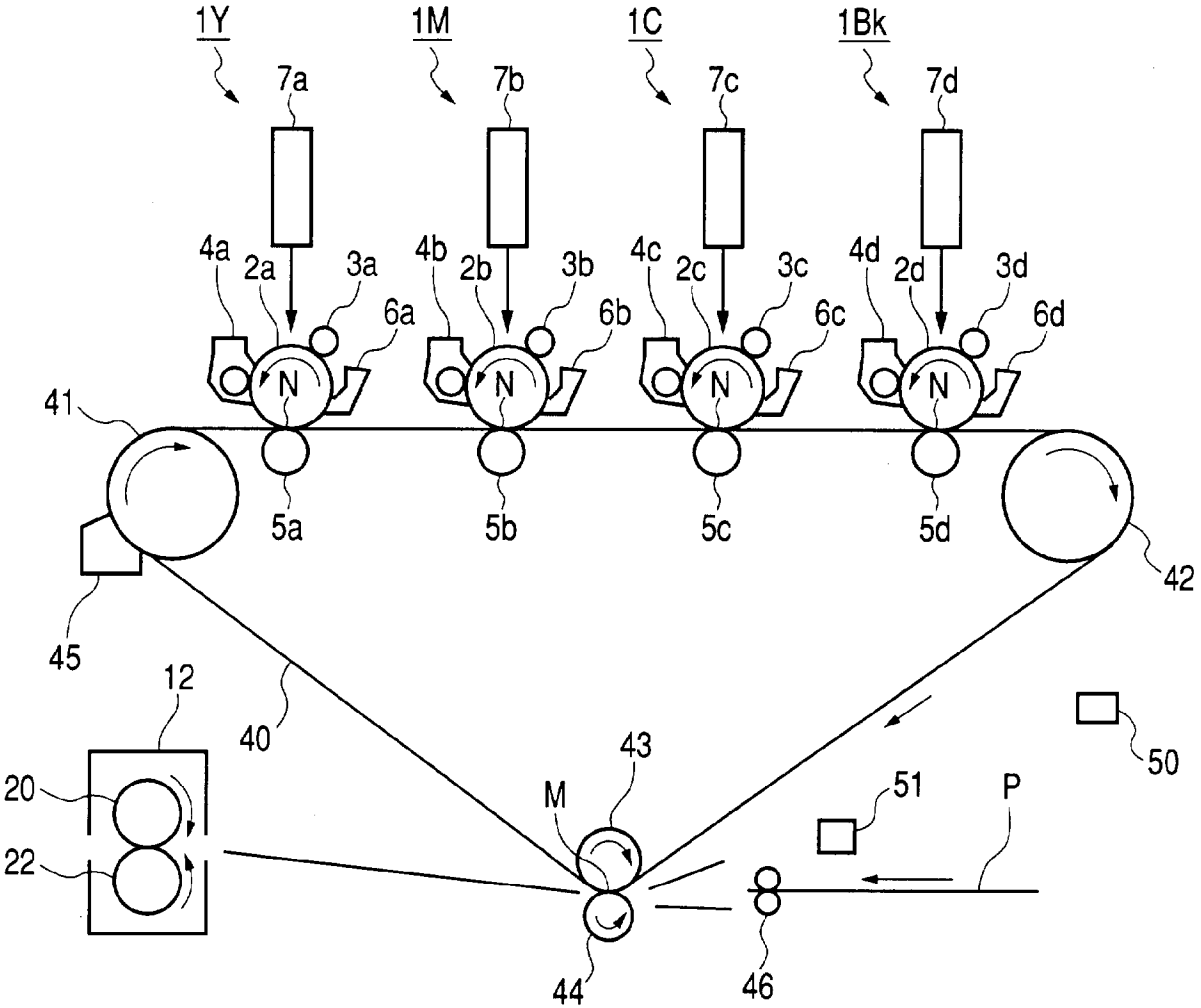
FIG. 1 is a schematic constructional view of a color image forming apparatus according to an embodiment of the present invention.

FIG. 1 is a schematic constructional view showing a color image forming apparatus according to a first embodiment of the present invention. The image forming apparatus according to this embodiment is a tandem type full-color printer of electro-photographic type.

The image forming apparatus includes four image forming portions (image forming units), i.e. an image forming portion 1Y for forming an yellow image, an image forming portion 1M for forming a magenta image, an image forming portion 1C for forming a cyan image and an image forming portion 1Bk for forming a black image, and these four image forming portions are arranged in a line with a predetermined distance therebetween.

The respective image forming portions, 1Y, 1M, 1C and 1Bk include respective photosensitive drums 2*a*, 2*b*, 2*c* and 2*d*. Around the respective photosensitive drums 2*a*, 2*b*, 2*c* and 2*d*, there are disposed electrifying rollers 3*a*, 3*b*, 3*c* and 3*d*, developing apparatuses 4*a*, 4*b*, 4*c* and 4*d*, transferring rollers 5*a*, 5*b*, 5*c* and 5*d* and drum cleaning apparatuses 6*a*, 6*b*, 6*c* and 6*d*, and exposing apparatuses 7*a*, 7*b*, 7*c* and 7*d* are disposed above and between the electrifying rollers 3*a*, 3*b*, 3*c*, 3*d* and the developing apparatuses 4*a*, 4*b*, 4*c*, 4*d*, respectively. The developing apparatuses 4*a*, 4*b*, 4*c* and 4*d* contain yellow toner, magenta toner, cyan toner and black toner, respectively.

An endless belt type intermediate transferring member 40 as a transferring medium abuts against respective primary transferring portions N of the respective photosensitive drums 2*a*, 2*b*, 2*c* and 2*d* of the image forming portions 1Y, 1M, 1C and 1Bk. The intermediate transferring belt 40 is mounted between a driving roller 41, a support roller 42 and a secondary transferring counter roller 43 and is rotated (shifted) by the driving roller 41 in a direction (clockwise direction) shown by the arrow.

The respective transferring rollers 5*a*, 5*b*, 5*c* and 5*d* for primary transferring abut against the respective photosensitive drums 2*a*, 2*b*, 2*c* and 2*d* with the interposition of the intermediate transferring belt 40 at the respective primary transferring nip portions N.

The secondary transferring counter roller 43 abuts against a secondary transferring roller 44 with the interposition of the intermediate transferring belt 40, thereby defining a secondary transferring portion M. The secondary transferring roller 44 can be contacted with and spaced apart from the intermediate transferring belt 40.

At the outside of the intermediate transferring belt 40, in the vicinity of the driving roller 41, there is provided a belt cleaning apparatus 45 for removing and collecting transferring residual toner remaining on a surface of the intermediate transferring belt 40.

Further, a fixing apparatus 12 is disposed at a downstream side of the secondary transferring portion M in a conveying direction of a recording material P.

Further, an environmental sensor 50 and a media sensor 51 are provided within the image forming apparatus.

When an image forming operation start signal (print start signal) is emitted, the respective photosensitive drums 2*a*, 2*b*, 2*c* and 2*d* of the image forming portions 1Y, 1M, 1C and 1Bk which are rotated at a predetermined process speed are uniformly electrified by the respective electrifying rollers 3*a*, 3*b*, 3*c* and 3*d* (negatively in this embodiment).

The exposing apparatuses 7*a*, 7*b*, 7*c* and 7*d* convert inputted color-decomposed image signals into light signals in respective laser output portions (not shown) and laser beams corresponding to the converted light signals are scanned on the electrified photosensitive drums 2*a*, 2*b*, 2*c* and 2*d* to expose the latter, thereby forming electrostatic latent images.

First of all, on the photosensitive drum 2*a* on which the electrostatic latent image was formed, yellow toner is electrostatically absorbed onto the latent image in accordance with electrifying potential by means of the developing apparatus 4*a* to which developing bias having the same polarity as electrifying polarity (negative polarity) of the photosensitive drum 2*a*, thereby visualizing the electrostatic latent image as a developed image. The yellow toner image is primarily transferred onto the rotating intermediate transferring belt 40 by the transferring roller 5*a* to which primary transferring bias (polarity (positive polarity) opposite to the toner) is applied at the primary transferring portion N. The intermediate transferring belt to which the yellow toner image was transferred is rotated toward the image forming portion 1M. Also in the image forming portion 1M, a magenta toner image formed similarly on the photosensitive drum 2*b* is transferred at the primary transferring portion N so that the magenta toner image is superimposed with the yellow toner image on the intermediate transferring belt 40.

Similarly, a cyan toner image formed on the photosensitive drum 2*c* of the image forming portion 1C and a black toner image formed on the photosensitive drum 2*d* of the image forming portion 1Bk are successively superimposed with the superimposed yellow and magenta toner images on the intermediate transferring belt 40 at the primary transferring portion N, thereby forming a full-color toner image on the intermediate transferring belt 40.

In synchronous with a timing that a leading end of the full-color toner image on the intermediate transferring belt 40 is shifted to the secondary transferring portion M, a recording material (transfer material) P is conveyed, by means of a pair of registration rollers 46, to the secondary transferring portion M, where the full-color toner image is collectively transferred onto the recording material P by the secondary transferring roller 44 to which secondary transferring bias (polarity (positive polarity) opposite to the toner) is applied. The recording material P on which the full-color toner image was formed is conveyed to the fixing apparatus 12, where the full-color toner image is heated and pressurized at a fixing nip portion between a fixing belt 20 and a pressurizing roller 22 to fuse and fix the toner image onto the surface of the recording material P. Thereafter, the recording material is discharged out of the image forming apparatus as an output image from the image forming apparatus. Then, a series of image forming operations are finished.

Incidentally, the environmental sensor 50 is provided within the image forming apparatus so that biases of the electrifying, developing, primary transferring and secondary transferring and the fixing condition can be changed in accordance with the atmospheric environments (temperature, humidity and the like) within the image forming apparatus and the environmental sensor is used for adjusting density of the toner image formed on the recording material P and to achieve optimum transferring and fixing conditions. Further, the media sensor 51 is provided within the image forming apparatus so that the transferring bias and the fixing condition can be changed in accordance with the recording material by discriminating the recording material P and is used for achieving the optimum transferring and fixing conditions for the recording material P.

Upon the above-mentioned primary transferring, the primary transferring residual toners remaining on the photosensitive drums 2*a*, 2*b*, 2*c* and 2*d* are removed and collected by the drum cleaning apparatuses 6*a*, 6*b*, 6*c* and 6*d*. Further, secondary transferring residual toner remaining on the intermediate transferring belt 40 after the secondary transferring is removed and collected by the belt cleaning apparatus 45.

(2) Fixing Apparatus 12

Figure 2:
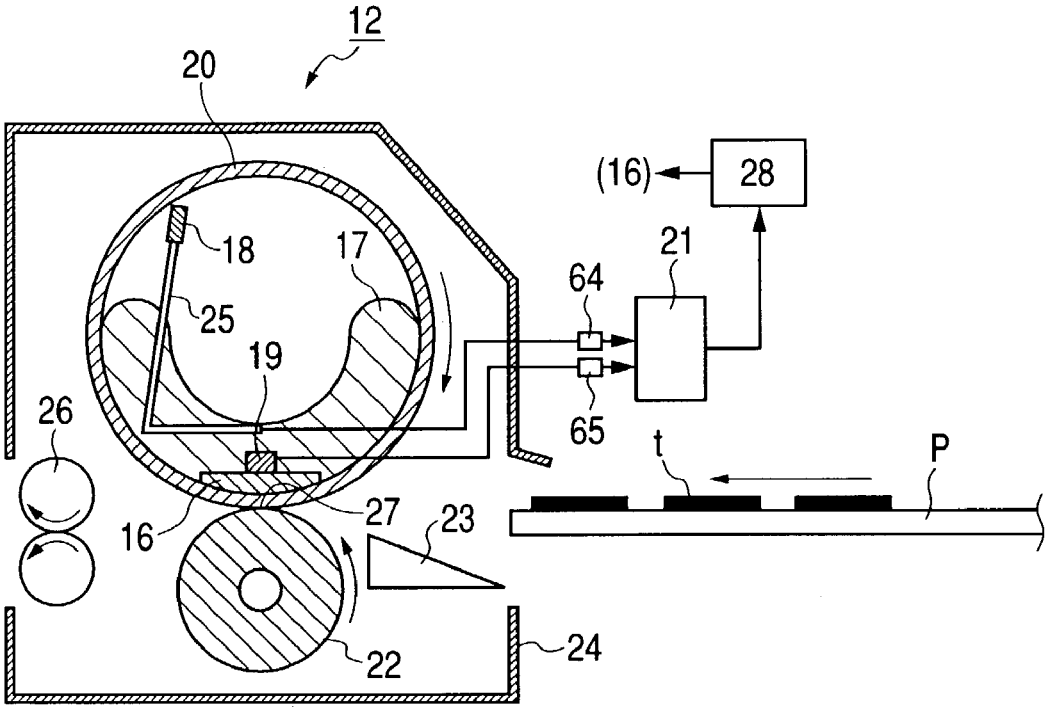
FIG. 2 is a schematic sectional view showing a fixing apparatus according to first to seventh embodiments of the present invention.

FIG. 2 is a schematic constructional view of the fixing apparatus according to this embodiment. The fixing apparatus of this embodiment is a fixing apparatus of fixing belt heating type and pressurizing rotary member driving, type (tension-less type).

1) Entire Construction of the Apparatus 12

The reference numeral 20 denotes the fixing belt as a first rotary member (first fixing member) and is a cylindrical (endless and sleeve-shaped) member in which an elastic layer is provided on a belt-shaped member. The fixing belt 20 will be described in detail in 6) which will be described later.

The reference numeral 22 denotes the pressurizing roller as a second rotary member (second fixing member). The reference numeral 17 denotes a heat resistive and rigid heat holder as a heating element holding member having a substantially half circular bucket cross-section and the reference numeral 16 denotes a fixing heater as a heating element (heat source) provided on a lower surface of the heater holder 17 along a longitudinal direction of the heater holder. The fixing belt 20 is loosely mounted around the heater holder 17. In this embodiment, the fixing heater 16 is a ceramic heater as fully explained in 6).

The heater holder 17 is formed from liquid crystal polymer resin having high heat-resistance and serves to hold the fixing heater 16 and to guide the fixing belt 20. In the illustrated embodiment, as the liquid crystal polymer, Zenight 7755 (goods name) manufactured by Du Pont Corporation is used. A maximum usable temperature of the Zenight 7755 is about 270° C.

The pressurizing roller 22 is constituted by forming a silicone rubber layer having a thickness of about 3 mm on a stainless steel core by injection molding and by coating a PFA resin tube having a thickness of about 40 μm on the silicone rubber layer. The pressurizing roller 22 is rotatably mounted by supporting both ends of the roller between front and rear side plates (not shown) of a frame 24 of the apparatus via bearings. The fixing belt unit comprising the fixing heater 16, heater holder 17 and fixing belt 20 is disposed on the pressurizing roller 22 in parallel with the pressurizing roller 22 with the heater 16 facing downwardly so that, by biasing both ends of the heater holder 17 by means of a pressurizing mechanism (not shown) with total pressure of 196 N (20 kgf) (one side: 98 N (10 kgf)) toward an axis of the pressurizing roller 22, the lower surface of the fixing heater 16 is urged, with the interposition of the fixing belt 20, against the elastic layer of the pressurizing roller 22 in opposition to elasticity of the elastic layer, thereby forming a fixing nip portion 27 having a predetermined width required for thermal fixing. The pressurizing mechanism includes a pressure releasing mechanism which can release the pressure to facilitate the removal of the recording material P, for example, if the recording material is jammed.

There are provided a main thermistor 18 as first temperature detecting means and a sub thermistor 19 as second temperature detecting means. The main thermistor 18 as the first temperature detecting means is not contacted with the fixing heater 16 as the heating element, and, in the illustrated embodiment, the main thermistor is elastically contacted with the inner surface of the fixing belt 20 above the heater holder 17 to detect a temperature of the inner surface of the fixing belt 20. The sub thermistor 19 as the second temperature detecting means is disposed nearer the fixing heater 16 as a heat source than the main thermistor 18, and, in the illustrated embodiment, the sub thermistor is contacted with a rear surface of the fixing heater 16 to detect a temperature of the rear surface of the fixing heater 16.

A thermistor element of the main thermistor 18 is attached to a tip end of a stainless steel arm 25 fixedly supported by the heater holder 17 so that the thermistor element is always contacted with the inner surface of the fixing belt 20 by elastically rocking the arm 25 even if movement of the inner surface of the fixing belt 20 becomes unstable.

Figure 3:
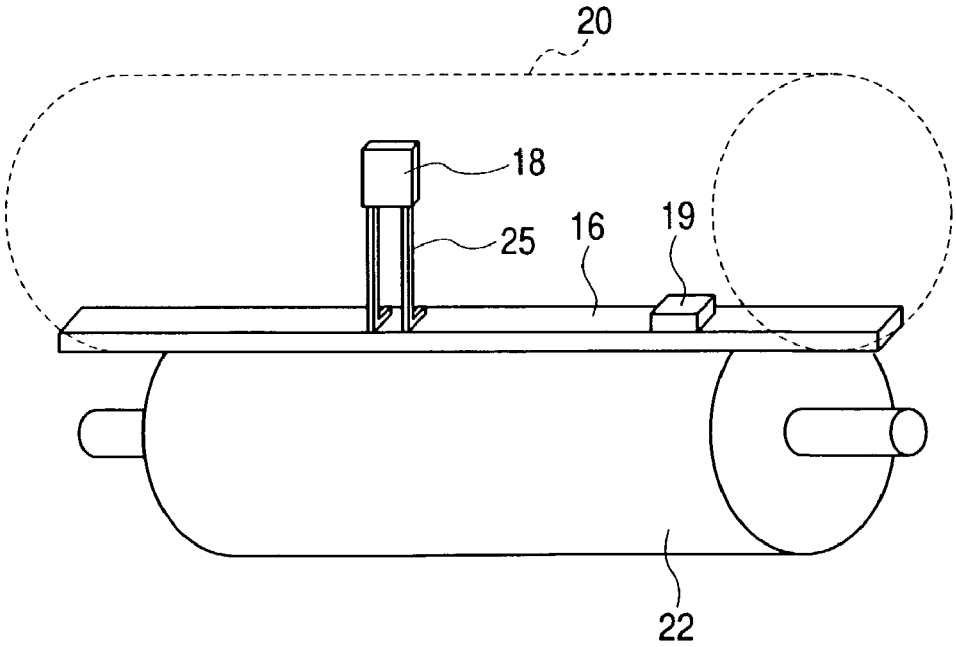
FIG. 3 is a schematic perspective view showing a positional relationship between a fixing heater and a main thermistor and a sub thermistor in the first to seventh embodiments of the present invention.
Figure 4A:
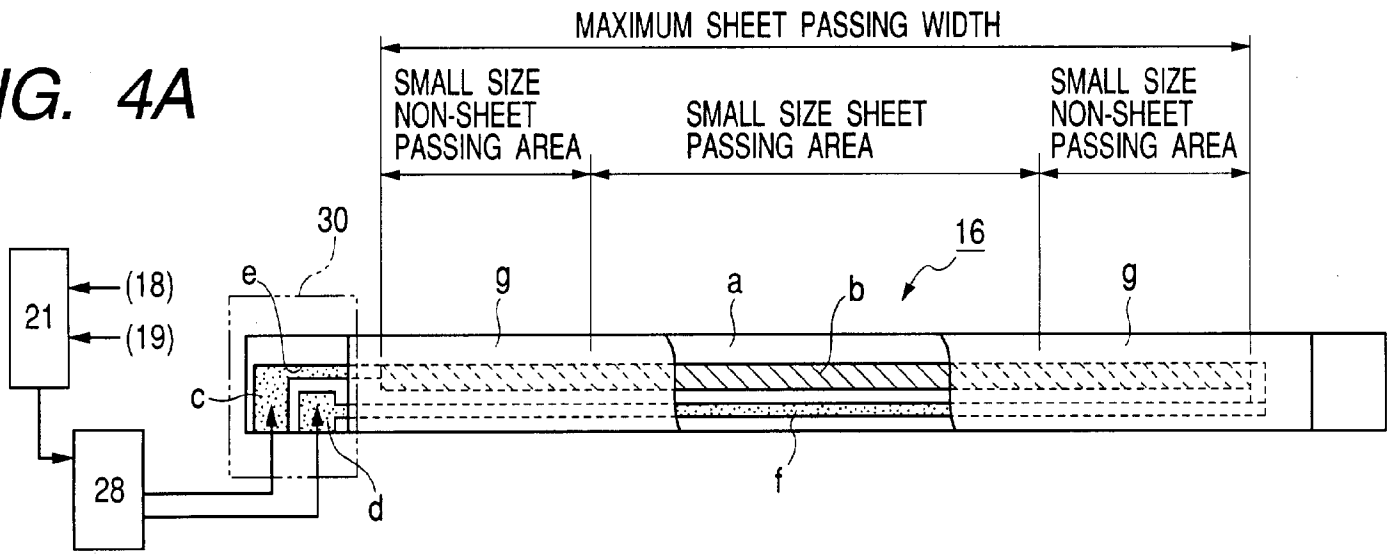
FIGS. 4A, 4B and 4C are chematic constructional views of a ceramic heater as a heating element.
Figure 4B:
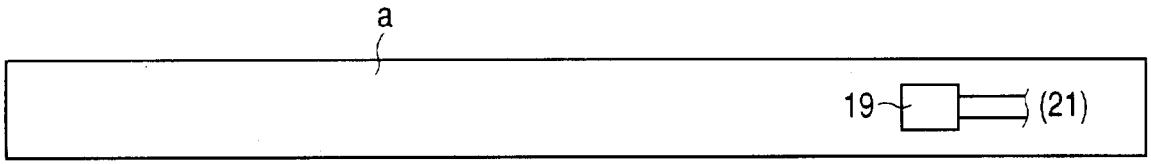
Figure 4C:
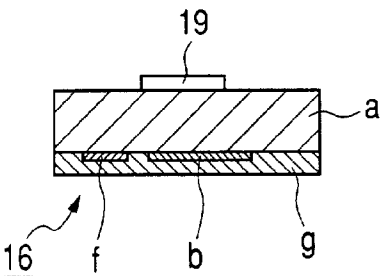

FIG. 3 is a schematic perspective view showing a positional relationship between the fixing heater and the main thermistor 18 and the sub thermistor 19 in the fixing apparatus according to the illustrated embodiment. The main thermistor 18 is disposed in the vicinity of a longitudinal center of the fixing belt 20 to contact with the inner surface of the fixing belt 20 and the sub thermistor 19 is disposed in the vicinity of an end of the fixing heater 16 to contact with the rear surface of the fixing heater 16.

Outputs of the main thermistor 18 and the sub thermistor 19 are connected to a control circuit portion (CPU) 21 via A/D converters 64 and 65, respectively and the control circuit portion 21 serves to determine a temperature control content of the fixing heater 16 on the basis of the outputs of the main thermistor 18 and the sub thermistor 19 and to control electrical communication to the fixing heater 16 by means of a heater driving circuit portion 28 (FIGS. 2, 3 and 4A to 4C) as electric power supplying portion (heating means).

There are further provided an inlet guide 23 and a paired discharging roller 26 which are assembled to the apparatus frame 24. The inlet guide 23 serves to direct the recording material so that the recording material P left the secondary transferring nip portion can correctly be guided to a fixing nip portion 27 as an abutment portion between the fixing belt 20 and the pressurizing roller 22 at the fixing heater 16. In the illustrated embodiment, the inlet guide 23 is made of polyphenylene sulfide (PPS) resin.

The pressurizing roller 22 is rotatingly driven by driving means (not shown) at a predetermined peripheral speed in a direction shown by the arrow. Upon the rotation of the pressurizing roller 22, by an abutment friction force between the outer surface and the fixing belt 20 at the fixing nip portion 27, a rotational force acts on the cylindrical fixing belt 20, with the result that the fixing belt 20 is rotatingly driven around the heater holder 17 in a direction shown by the arrow while the inner surface of the fixing belt is being closely contacted and slid on the lower surface of the fixing heater. Grease is coated on the inner surface of the fixing belt 20 to ensure smooth sliding movement between the heater holder and the inner surface of the fixing belt 20.

In a condition that the pressurizing roller 22 is rotatingly driven and the cylindrical fixing belt 20 is rotated accordingly and the electric power is supplied to the fixing heater 16 so that the start-up temperature control to increase the temperature of the fixing heater 16 to the predetermined temperature, the recording material P bearing an unfixed toner image is introduced between the fixing belt 20 and the pressurizing roller 22 at the fixing nip portion 27 while being guided by the inlet guide 23, and, at the fixing nip portion 27, a surface of the recording material P which bears the toner image is closely contacted with the outer surface of the fixing belt 20 and is pinched and conveyed by the fixing nip portion 27 together with the fixing belt 20. During such pinching and conveyance, heat from the fixing heater is applied to the recording material P via the fixing belt 20, so that the unfixed toner image t on the recording material P is fused and fixed onto the recording material P by heat and pressure. The recording material P passed through the fixing nip portion 27 is self-stripped from the fixing belt 20 by curvature and is discharged by the paired fixing discharging roller 26.

2) Main Thermistor 18

As shown in FIGS. 2 and 3, the main thermistor 18 is disposed in the vicinity of the longitudinal center of the fixing belt 20 to contact with the inner surface of the fixing belt 20. The main thermistor 18 is used as means for detecting the temperature of the fixing belt 20 which is a temperature nearer to the temperature of the fixing nip portion. Thus, in a normal operation, temperature control is performed so that the detection temperature of the main thermistor 18 becomes a target temperature.

3) Sub Thermistor 19

As shown in FIG. 3, the sub thermistor 19 is disposed in the vicinity of the fixing heater 16 to contact with the rear surface of the fixing heater 16. The sub thermistor 19 serves to detect the temperature of the fixing heater 16 as the heating element and acts as a safety device for monitoring so that the temperature of the fixing heater does not exceed a predetermined temperature. Further, overshoot of the temperature of the fixing heater 16 in the start-up and end temperature increase are monitored by the sub thermistor 19, and this is used for judging to perform control for reducing through-put so that, for example, if the temperature of the end of the fixing heater 16 exceeds a predetermined temperature due to the end temperature increase, the end temperature increase is not further worsened.

4) Fixing Heater 16

In the illustrated embodiment, the fixing heater 16 as the heat source uses a ceramic heater in which conductive paste including alloy of silver/palladium is coated on a substrate made of aluminum nitride by screen printing as a film having a uniform thickness to form a resistive heating element and a pressure tightness glass coat is provided on the film.

FIG. 4 a schematic constructional view showing an example of such a ceramic heater, where a section (a) thereof is a partial fragmental schematic view of the ceramic heater, a section (b) is a schematic rear view and a section (c) is an enlarged schematic cross-sectional view.

The Fixing Heater 16 is constituted by

I. An elongated aluminum nitride substrate a having a longitudinal direction perpendicular to a sheet passing direction;

II. A resistive heating element layer b made of conductive paste including alloy of silver/palladium (Ag/Pd) having a thickness of about 10 μm and a width of about 1 to 5 mm and coated on a front surface of the aluminum nitride substrate a along the longitudinal direction thereof by screen printing as a line shape or a strip shape, which layer generates heat when electric current flows through the layer;

III. First and second electrode portions c and d and extension electrical path portions e and f pattern-formed on the front surface of the aluminum nitride substrate a by screen printing using silver paste, as electric power dispatching patterns for the resistive heating element layer b;

IV. A thin glass coat g having a thickness of about 10 μm and capable of enduring sliding friction with respect to the fixing belt 20, which glass coat is formed on the resistive heating element layer b and the extension electrical path portions e and f in order to ensure protection and insulation of the resistive heating element layer and the extension electrical path portions; and V. The sub thermistor 19 provided on a rear surface of the aluminum nitride substrate a.

The fixing heater 16 is fixedly supported by the heater holder 17 so that the front surface thereof is directed downwardly and is exposed.

An electric power dispatching connector 30 is connected to the first and second electrode portions c and d. When the electric power is supplied to the first and second electrode portions c and d from the heater driving circuit 28 through the electric power dispatching connector 30, the resistive heating element layer b generates the heat, thereby increasing the temperature of the fixing heater 16 quickly. The heater driving circuit 28 is controlled by the control circuit portion (CPU) 21.

In the normal usage, at the same time when the rotation of the pressurizing roller 22 is started, the driven rotation of the fixing belt 20 is started, and as the temperature of the fixing heater 16 is increased, the temperature of the inner surface of the fixing belt 20 is increased. The supplying of the electric power to the fixing heater 16 is controlled by PID control, and the applied electric power is controlled so that the temperature of the inner surface of the fixing belt 20 and thus the detection temperature of the main thermistor 18 becomes 190° C.

5) Fixing Heater Driving Circuit Portion 28

Figure 5:
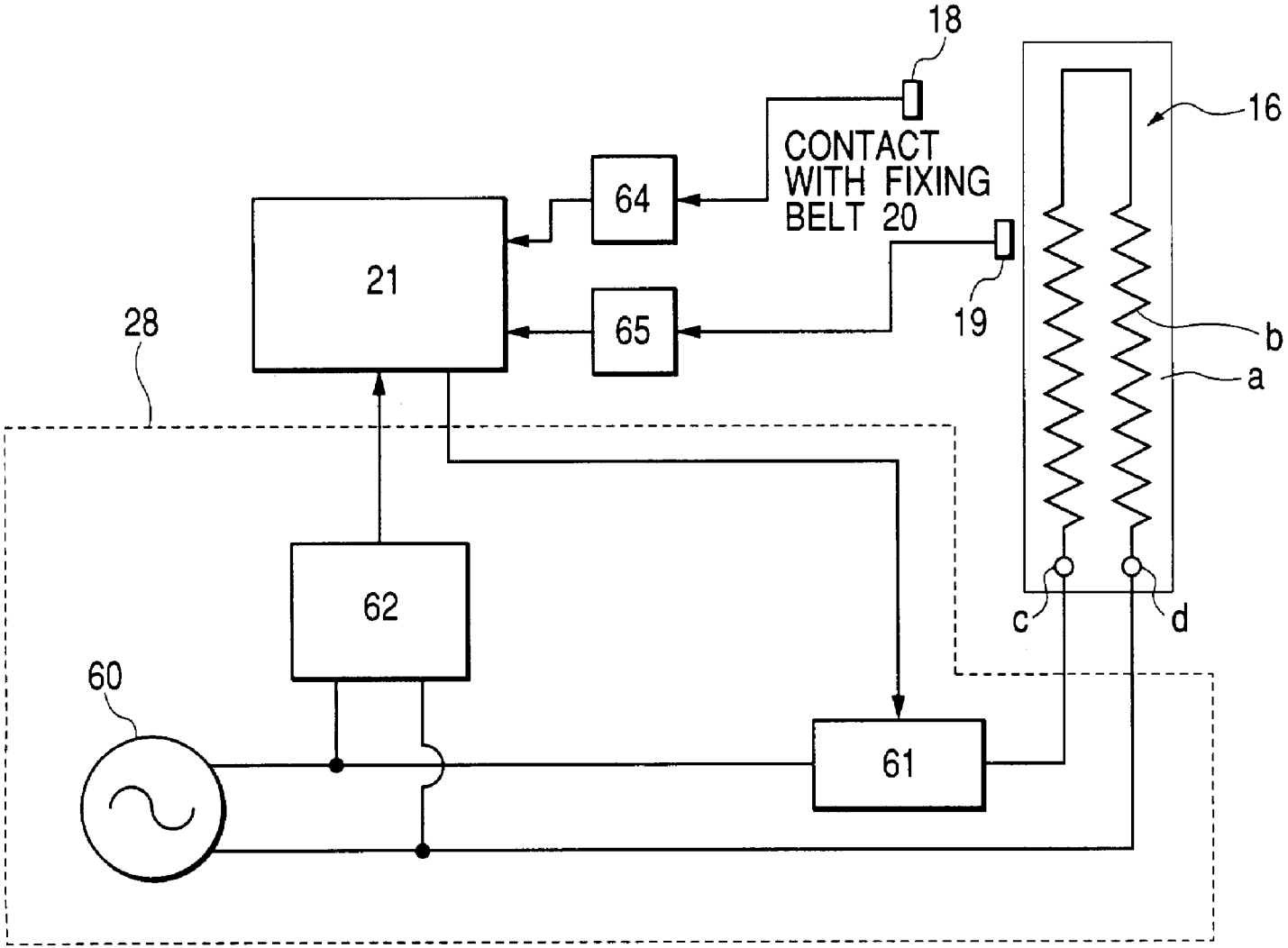
FIG. 5 is a block diagram showing a control circuit portion (CPU) and a fixing heater driving circuit portion of the fixing apparatus of the present invention.

FIG. 5 is a block diagram of the control circuit portion (CPU) 21 as the temperature control means of the fixing means and the fixing heater driving circuit portion 28. The electric power dispatching electrode portions c and d of the fixing heater 16 are connected to the fixing heater driving circuit portion 28 via an electric power dispatching connector (not shown).

The fixing heater driving circuit portion 28 includes an AC power supply 60, a Triac 61 and a zero-cross generating circuit 62. The Triac 61 is controlled by the control circuit portion (CPU) 21. The Triac 61 serves to perform power supplying/power blocking with respect to the resistive heating element layer b of the fixing heater 16.

The AC power supply 60 sends a zero-cross signal to the control circuit portion 21 through the zero-cross detecting circuit 62. The control circuit portion 21 controls the Triac 61 on the basis of the zero-cross signal. By supplying the electric power from the fixing heater driving circuit portion 28 to the resistive heating element layer b of the fixing heater 16 in this way, the temperature of the entire fixing heater 16 is increased quickly.

Outputs of the main thermistor 18 for detecting the temperature of the fixing belt 20 and the sub thermistor 19 for detecting the temperature of the fixing heater 16 are received by the control circuit portion (CPU) 21 through the A/D converters 64 and 65, respectively.

The control circuit portion 21 controls the electric power supplied to the heater by phase and wave number control of AC voltage applied to the fixing heater 16 by means of the Triac 61 on the basis of temperature information of the fixing heater 16 from the main thermistor 18, thereby controlling so that the temperature of the fixing heater 16 is maintained to a predetermined target temperature (set temperature).

That is to say, the temperatures of the main thermistor 18 and the sub thermistor 19 are monitored as voltage values by the control circuit portion 21, whereby the electric power supplied to the fixing heater 16 is controlled so that the temperature of the fixing belt 20 is maintained to the predetermined set temperature by temperature control and the fixing heater 16 is driven within the predetermined temperature range.

As a representative temperature control system, the PID control is used. Further, as electric power controlling methods, although there are wave number control, phase control and the like, here, explanation is made by using the phase control.

That is to say, the control circuit portion 21 detects the temperature of the main thermistor 18 every 2 μsec, and the electric power amount supplied to the fixing heater 16 is determined by the PID control so as to control to the desired temperature control temperature within the control circuit portion 21. For example, in order to perform designation of the electric power at a pitch of 5%, generally, a communication angle having a pitch of 5% with respect to one and half wave of AC wave forms supplied from the power supply is used. The communication angle is sought as timing for turning ON the Triac 61 on the basis of a time when the zero-cross signal is detected by the zero-cross generating circuit 62.

6) Fixing Belt 20

In the illustrated embodiment, the fixing belt 20 is a cylindrical (endless) member having an elastic layer provided on a belt-shaped member.

Concretely, a silicone rubber layer (elastic layer) having a thickness of about 300 μm is formed on a cylindrical endless belt (belt substrate) made of SUS and having a thickness of 30 μm by a ring coating method and a PFA resin tube (outermost surface layer) having a thickness of 30 μm is coated on the elastic layer. The heat capacity of the fixing belt 20 having the above-mentioned construction was measured as $12.2\times10^{-2}$ J/cm$^{2}$·° C. (heat capacity per 1 cm$^{2}$ of fixing belt).

I. Base Layer of Fixing Belt

Although the base layer of the fixing belt 20 can be formed from resin such as polyimide, since metal such as SUS or nickel has greater heat transfer characteristics than polyimide by about 10 times and can provide higher on-demand property, in the illustrated embodiment, the base layer of the fixing belt 20 is made of SUS metal.

II. Elastic Layer of Fixing Belt

As the elastic layer of the fixing belt 20, a rubber layer having relatively high heat transfer characteristics is used. The reason is to provide higher on-demand property. The material used in the illustrated embodiment has specific heat of about $12.2\times10^{-1}$ J/g·° C.

III. Mold Releasing Layer of Fixing Belt

By providing a fluoro-resin layer on the surface of the fixing belt 20, a mold releasing ability of the surface so that an offset phenomenon in which the toner is once adhered to the surface of the fixing belt 20 and then is shifted onto the recording material P again can be prevented. Further, by forming the fluoro-resin layer on the surface of the fixing belt 20 by a PFA tube, it is possible to form a uniform fluoro-resin layer more simply.

IV. Heat Capacity of Fixing Belt

In general, when the heat capacity of the fixing belt 20 is increased, the temperature start-up is delayed and the on-demand property is worsened. For example, depending upon the construction of the fixing apparatus, when it is supposed that the start-up is established within one minute without stand-by temperature control, it is known that the heat capacity of the fixing belt 20 is necessary to be about 4.2 J/cm$^{2}$·° C. or less.

In the illustrated embodiment, it is designed so that, when the start-up is carried out from a room temperature, the electric power of about 1000 W is applied to the fixing heater 16 so that the fixing heater 16 starts-up to 190° C. within 20 seconds. The silicone rubber layer is formed from material having specific heat of about $12.2\times10^{-1}$ J/g·° C. and, in this case, the thickness of the silicone rubber layer must be equal to or smaller than 500 μm and the heat capacity of the fixing belt 20 must be equal to or smaller than about 18.9×10⁻2 J/cm$^{2}$·° C. Further, conversely, if the heat capacity tries to be equal to or smaller than $4.2\times10^{-2}$ J/cm$^{2}$·° C., the rubber layer of the fixing belt 20 becomes extremely thick, with the result that the image quality such as OHT permeability and gloss unevenness will be the same as that in an on-demand apparatus having no elastic layer.

In the illustrated embodiment, the thickness of the silicone rubber required for obtaining a high quality image by setting OHT permeability and gloss was 200 μm or more. In this case, the heat capacity was $8.8\times10^{-2}$ J/cm$^{2}$·° C.

Namely, in the construction of the fixing apparatus similar to that in the illustrated embodiment, general subject of the heat capacity of the fixing belt 20 is from $4.2\times10^{-2}$ J/cm$^{2}$·° C. to 4.2×J/cm$^{2}$·° C. Among them, the fixing belt having the heat capacity of from $8.8\times10^{-2}$ J/cm$^{2}$·° C. to $18.9\times10^{-2}$ J/cm$^{2}$·° C., which permits compatibility between better on-demand property and the high quality, was used.

(3) Temperature Control of Fixing Apparatus Upon Starting of Sheet Passing

In the illustrated embodiment, when the electric power applied to the fixing heater 16 is corrected, an electric power substantially the same as a necessary electric power value required fir fixing heater in consideration of difference in heat capacity due to a basis weight of the recording material P is applied in synchronous with a timing that the recording material P rushes into the fixing nip portion. The reason is that, in a case where continuous sheet passing is carried out under the same condition, it has experimentally been found that the necessary electric power value is varied with the basis weight of the recording material P.

In the illustrated embodiment, the electric power to be applied to the fixing heater 16 is corrected by using a table in which several cases are determined on the basis of paper modes from the necessary electric values sought by the experiment. In actual, when the user designates a print mode, the control circuit portion 21 receives print mode information from a host computer 70 together with the print signal and determines the applied electric power for sheet passing.

A relationship between the paper modes and the applied electric power for sheet passing in the illustrated embodiment is shown in the following Table 1.

TABLE 1

Relationship between paper modes and applied electric power for sheet passing

| basis weight (g/m$^{2}$) | paper mode | applied electric power for sheet passing E2 (W) |
|---|---|---|
| 50 to 60 | thin paper | 230 |
| 61 to 105 | normal paper | 275 |
| 106 to 128 | thick paper 1 | 300 |
| 129 to 176 | thick paper 2 | 310 |

The time for applying the predetermined electric power without PID control is selected so that the temperature ripple of the fixing belt 20 is minimized. From before the recording sheer P rushing upon starting of the sheet passing, the corrected electric power is applied. The reason is that, if the corrected electric power is applied at the same time when the recording material P rushes into the fixing nip portion, reduction in temperature of the fixing belt 20 may be increased. If the timing for applying the corrected electric power is too fast, the increase in temperature of the fixing belt 20 becomes great; whereas, if too slow, as mentioned above, the temperature of the fixing belt 20 is decreased after the recording material P rushes into the fixing nip portion. In the illustrated embodiment, the proper timing of about 0.5 second was used. Further, if the time for applying the predetermined electric power without PID control is too short, since it approaches the normal PID control, the effect of predetermined electric power applying will be reduced. If such time is too long, the change in temperature of the fixing belt during the sheet passing will become great, with the result that the temperature ripple becomes great when returned to the PID control. Thus, in the illustrated embodiment, the predetermined electric power applying control was performed for about 1 second before the starting of the sheet passing by about 0.5 second.

Figure 10:
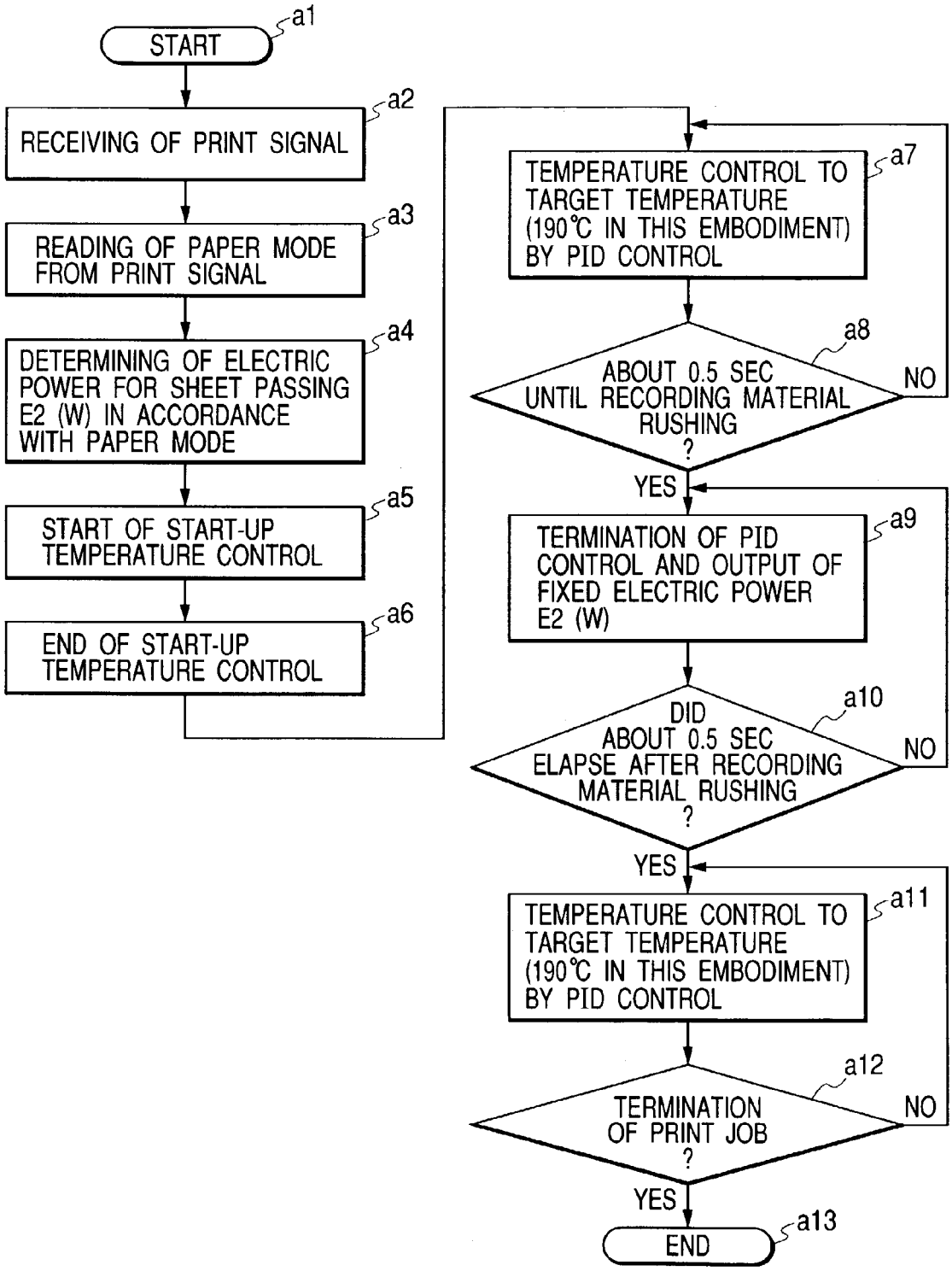
FIG. 10 is a flow chart showing a method for correcting an electric power to be substantially the same as a necessary electrical power value required for a fixing heater 16 in consideration of a difference in heat amount due to a basis weight of a recording material P, in the first embodiment of the present invention.

FIG. 10 shows a flow chart of the electric power controlling method in the illustrated embodiment.

Now, the actual correcting operation will be explained with reference to the flow chart.

In FIG. 10, after the power supply is turned ON, the image forming apparatus starts-up to a condition capable of receiving the print signal (step a1). When receives print command from the host computer (not shown) (step a2), the paper mode is read from the print signal (step a3). The control circuit portion (CPU) 21 of the printer determines the applied electric power E2 (W) for sheet passing corresponding to the paper mode as shown in the Table 1 (step a4) Thereafter, the control circuit portion 21 drives the heater driving circuit 28 to start the start-up temperature control of the heater 21 thereby to temperature-control the fixing belt 20 to the predetermined temperature (step a5). When the fixing belt 20 approaches the predetermined temperature and the start-up temperature control is finished (step a6), 190° C. as the print temperature control temperature is set as the target temperature and the temperature control is performed by the PID control to achieve the target temperature (step a7). Thereafter, waiting is executed at the target temperature while performing the PID control till about 0.5 second until the recording material rushing (step a8).

When about 0.5 second until the recording material rushing is reached, the PID control is stopped and the predetermined electric power E2 (W) determined in the step a4 is outputted as the applied electric power for sheet passing (step a9), and the electric power E2 (W) continues to be applied continuously until about 0.5 second after the recording sheet rushing (step a10). Thereafter, 190° C. as the print temperature control temperature is set as the target temperature and the PID control is started again (step a11).

The above-mentioned operations are continued until the print is finished (step a12), and, upon termination of the print job, the temperature control is ended (step a13) This correction is performed on the basis of the table (Table 1) showing the relationship between the paper mode and the applied electric power E2 (W) for sheet passing, provided in the control circuit portion (CPU) 21 of the printer.

As mentioned above, by stopping the PID control for the predetermined time period before and after the timing of the recording material P conveying into a nip region and by correcting the electric power to be applied to the fixing heater to the predetermined value and applying the corrected value, the change in temperature associated with the recording material P conveying into a nip region upon the starting of the sheet passing due to waste time of the temperature detection is not generated, thereby permitting more stable temperature control.

Further, by correcting the predetermined electric power in consideration of the difference in heat capacity due to the basis weight of the recording material P, the stable temperature control can be performed regardless of the heat capacity of the recording material P.

(4) Temperature Measurement Result and Image Output Test Result when Using the Illustrated Embodiment In the illustrated embodiment, the PID control is inhibited for about 1 second from about 0.5 second until the recording material conveying into a nip region upon starting of the sheet passing and the fixed electric power is applied on the basis of the Table 1 and, thereafter, the PID control is started again. As mentioned above, the electric power applied in this case is determined in accordance with the basis weight of the paper. The time period during when the IPD control is inhibited and the predetermined electric power is applied is selected to about 1 second from about 0.5 second until the recording material conveying into a nip region, for the above reason.

1) Testing Method

The fixing apparatus is rotated at the process speed of 87 mm/sec and the detection temperature of the main thermistor 18 is temperature-controlled to be 190° C. and adequate time is elapsed.

In this condition, recording materials which are New NPI high quality papers 128 g having basis weight of 128 g/m$^2$ (goods name; manufactured by Nippon Seishi Co., Ltd) were continuously passed (16 sheets per minute).

In this case, as the temperature of the inner surface of the fixing sleeve 20, the temperature measurement value of the main thermistor 18 was recorded. Further, regarding the electric power, measurement was performed by A/D-converting output of the electric power value through WT 200 DIGITAL POWER METER (manufactured by YOKOGAWA) by means of a PC temperature recorder NR250 (manufactured by Keyence Inc.) and by taking the converted value into a PC.

Regarding the gloss of the fixed image, a glossimeter PG-3D manufactured by Nippon Denshoku Kogyo Co. Ltd was used as a measuring device and measurement was performed by using 75 degree mirror surface gloss measuring method based on JIS Z 8741.

Regarding the toner amount on the recording material, the fixing was performed in a condition that a toner amount of a solid image portion of so-called primary colors such as yellow, magenta, cyan and black colors is about 0.5 to 0.6 mg/cm$^2$ and a toner amount of a solid image portion of so-called secondary colors (image obtained by superimposing two colors) such as red, green and blue colors is about 1.0 to 1.2 mg/cm$^2$, and gloss of the fixed image was measured.

In rubbing test for evaluating the fixing ability, a black solid image having a dimension of 5 mm×5 mm was formed on the recording material P and the fixing was performed at a speed of 16 rpm by using the fixing apparatus according to the illustrated embodiment for 50 sheets continuously, and, thereafter, in a condition that a weight having a predetermined weight (200 g) is rested on the imaged surface with the interposition of Sylbon C (goods name), the imaged surface was frictionally slid reciprocally by five times, and reflection density reduction rates (%) were sought before and after the frictional sliding. It is said that the smaller the changing rate of the reflection density (density reduction rate) the better the fixing ability. The reflection density was measured by using Gretag Macbeth RD918 (goods name). In the measurement, among 50 recording materials subjected to the fixing, regarding first, second, third, fifth, tenth, twentieth, thirtieth, fortieth and fiftieth recording materials, the density reduction rates were measured at nine points on each recording material and the worst values were used.

2) Test Results

Figure 7:
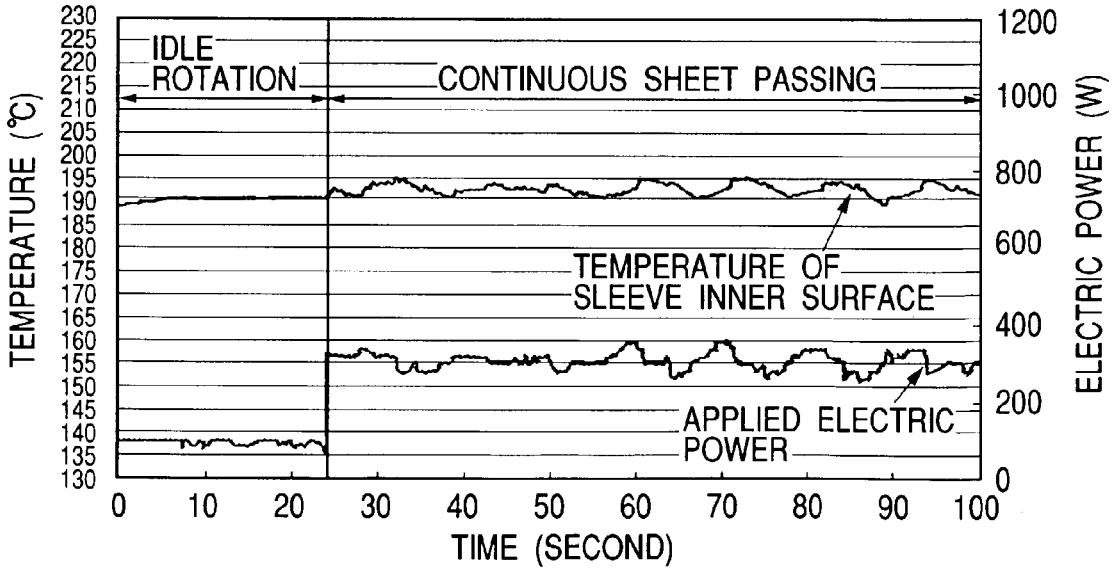
FIG. 7 is a graph showing a temperature change and an applied electric power before and after a media are passed in the fixing apparatus according to the first embodiment of the present invention.

FIG. 7 shows a graph recording changes of the electric power applied to the fixing heater 16 and the temperature of the inner surface of the fixing belt 20 before and after the sheet passing in the fixing apparatus according to the illustrated embodiment.

As shown in FIG. 7, before and after the recording material P rushes into the fixing nip portion, the stable temperature control (temperature ripple of about 7° C.) was indicated.

In this case, regarding the electric power applied to the fixing heater 16 before and after the recording material P rushes into the fixing nip portion, although the electric power was about 80 W in the idle rotation, the electric power of about 300 W was forcibly applied before 0.5 second until the recording material P rushes into the fixing nip portion, with the result that the stable temperature control could be achieved without causing great electric power fluctuation after the recording material P rushes into the fixing nip portion.

As such, so long as the temperature ripple could be maintained within about 7° C., the gloss change in the single outputted print was about 4 for single color and about 6 for secondary color. The following Table 2 shows average values of gloss of respective colors in the single recording material and change widths of gloss in the single recording material, in the illustrated embodiment. In this way, by applying the present invention, stable gloss in which the average value is relatively great and the change width in the single recording material is small can be obtained.

TABLE 2

| | | Glosses and their change widths for respective colors in the illustrated embodiment | |
|---|---|---|---|
| | | Gloss average | Change widths |
| Single color | Yellow | 13 | 4 |
| | Magenta | 13 | 4 |
| | Cyan | 12 | 4 |
| | Black | 9 | 4 |
| Secondary color | Red | 19 | 6 |
| | Green | 18 | 6 |
| | Blue | 18 | 6 |

Further, the worst value of the density reduction rate in the fixing ability test was 15% and the good fixing ability could be obtained.

(5) COMPARATIVE EXAMPLE 1

In the conventional fixing apparatus, the predetermined electric power was not applied before and after the recording material P rushing and temperature control was performed by all PID control.

1) Testing Method

Since the test was carried out by using the fixing apparatus construction and measuring method same as those in the test in the first embodiment, explanation of them will be omitted here. However, as mentioned above, the control in the conventional fixing apparatus differs from the control in the first embodiment in the point that the predetermined electric power is not applied and temperature control is performed by all PID control.

2) Test Result

Figure 6:
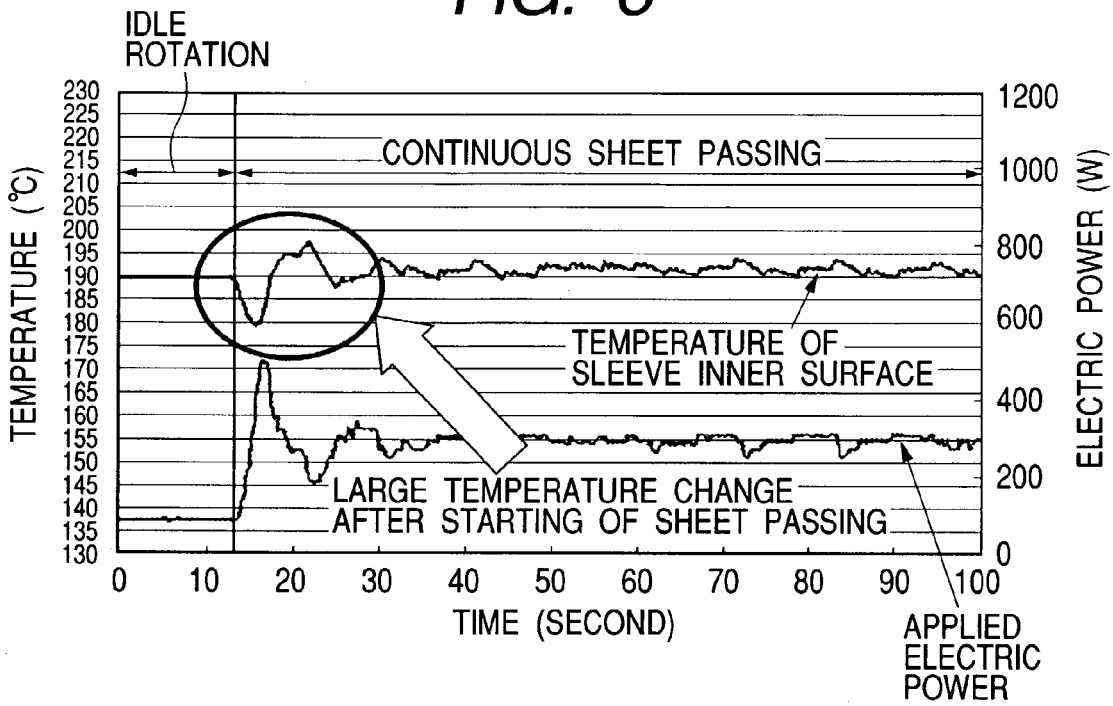
FIG. 6 is a graph showing a temperature change and an applied electric power before and after a media are passed in a conventional fixing apparatus.

FIG. 6 shows a graph recording an electric power applied to the fixing heater before and after the recording material rushes into the fixing nip portion and change in temperature of the inner surface of the fixing belt 20, in the fixing apparatus according to the comparative example 1.

As shown in FIG. 6, during the idle rotation before the recording material P rushes into the fixing nip portion, although the temperature of the inner surface of the fixing sleeve 20 has stable behavior, immediately after the recording material P rushes into the fixing nip portion, the temperature of the inner surface of the fixing sleeve 20 is once decreased to a value smaller than the target temperature by about 10° C. and then is increased up to a temperature greater than the target temperature by about 7° C. Thereafter, it takes about 10 seconds till the temperature of the inner surface of the fixing sleeve 20 is stabilized, and the temperature ripple was about 17° C. In the subsequent continuous sheet passing of the recording materials P, stable temperature control (temperature ripple of about 6° C.) was indicated.

As such, when the temperature ripple of about 17° C. was generated, in the electro-photographic color image forming apparatus of in-line type used in the test, the gloss of the outputted print was changed by about 9 for single color and about 14 for secondary color, with the result that the image quality was worsened (Table 3).

TABLE 3

| | | Glosses and their change widths for respective colors in the conventional example | |
|---|---|---|---|
| | | Gloss average | Change widths |
| Single color | Yellow | 13 | 9 |
| | Magenta | 13 | 9 |
| | Cyan | 12 | 9 |
| | Black | 9 | 7 |
| Secondary color | Red | 19 | 14 |
| | Green | 18 | 14 |
| | Blue | 18 | 14 |

Further, the worst value of the density reduction rate in the fixing ability test was 28%. If the fixing ability exceeds 20%, when the user uses the image, problems that not only the image is peeled or a half tone image becomes dim but also user's hands and/or cloths and/or other papers are contaminated will occur.

An area on the recording material P where the density reduction rate is great corresponds to an area where the temperature of the inner surface of the fixing belt 20 is reduced, and it was found that partial temperature reduction due to the temperature ripple affects an influence upon the fixing ability. As such, in this comparative example, dispersion in fixing ability at measuring points is great and adequate performance for the fixing apparatus cannot be obtained.

(6) Consideration

The effect for applying the electric power having the predetermined fixed value before and after the recording material P rushes into the fixing nip portion can be considered as follows:

In the idle rotation and the sheet passing, in the stable condition, the electric power applied to the fixing heater 16 is substantially constant. It is assumed that an electric power value required for pre-rotation in the normal condition is E1 (W) and an electric power value required for recording material passing in the normal condition is E2 (W).

When the recording material P rushes into the fixing nip portion, the temperature of the fixing belt 20 is suddenly decreased by the presence of the recoding material. In the normal PID control, the temperature change is detected by the main thermistor 18 and then the electric power control is performed. Thus, in a case where the main thermistor 18 is spaced apart from the heat generating portion, when the abrupt temperature change is generated, since the detection temperature of the main thermistor 18 indicates a value different from the actual temperatures of the fixing heater 16 and the fixing nip portion, excessive electric power may be applied or the applied electric power may be insufficient. As a result, the temperature ripple is generated and the temperature of the inner surface of the fixing sleeve 20 becomes unstable.

To the contrary, in the illustrated embodiment, since the electric power value E2 (W) previously required is applied as the fixed value in synchronous with the timing that the recording material P rushes into the fixing nip portion, excess and deficiency of the electric power do not occur. Accordingly, it is possible to reduce the temperature ripple in comparison with the normal PID control.

It is not required that the applying of the predetermined electric power be continued for a long time, but, so long as the electric power is applied until the temperature of the inner surface of the fixing belt 20 is stabilized to some extent, even when the normal PID control is restored, well stable temperature control can be achieved.

Further, since the heat amount removed from the fixing belt 20 by the sheet passing is differentiated depending upon the nature of the recording material P, in the illustrated embodiment, particularly, the basis weight of the recording material P is perceived so that the correction to substantially necessary electric power in consideration of difference in the heat capacity is performed.

In this way, stable temperature control (temperature ripple of about 7° C.) can be achieved.

(7) Regarding Predetermined Electric Power

Incidentally, the predetermined electric power value applied upon starting of the sheet passing may be substantially the same as E2 (W) and the difference from E2 (W) may be within a range for achieving the desired temperature ripple.

That is to say, in the illustrated embodiment, the predetermined electric power (offset electric power for sheet passing) applied before and after the recording material rushes into the fixing nip portion is determined on the basis of the paper mode. In this case, the electric power required in the media corresponding to the paper mode may not be precisely coincided but may be substantially the same. The reason is that, after the predetermined electric power is applied for the predetermined time period, the PID control is restored again for controlling to approach the target temperature. Namely, if not precisely coincided, although the temperature goes away from the target temperature, thereafter, by performing the PID control again, the temperature is controlled to approach the target temperature. The temperature change in this case may be within the desired temperature ripple.

Generally, in a case where the print speed is fast, since the difference in proper offset electric power for sheet passing caused by the difference in the basis weight of the recording material P is further increased, it is required that the offset electric power for sheet passing be divided into cases in more detail than the illustrated embodiment. In such a case, by further subdividing the paper modes or by corresponding to the basis weight by utilizing a paper thickness sensor, further fine correspondence between the basis weight and the offset electric power for sheet passing is obtained, thereby permitting the temperature control within the desired temperature ripple.

(8) Conclusion

As mentioned above, in the first embodiment, by inhibiting the PID control for the predetermined time period and by correcting the electric power applied to the fixing heater 16 to the predetermined value and by applying the corrected electric power before and after the timing that the recording material P rushes into the fixing nip portion upon starting of the sheet passing, more stable temperature control can be achieved without the temperature change caused by the recording material P rushing upon starting of the sheet passing due to the waste time of the temperature detection.

Further, when the applied electric power is determined, by performing the correction in consideration of the difference in heat capacity due to the basis weight of the recording material P, further correct and stable temperature control can be achieved.

By reducing the temperature ripple, the correct temperature control of the fixing member is performed, with the result that the good fixing ability can be obtained, whereby a high quality image which does not generate a poor image that would be caused if the fixing temperature control temperature is improper and in which there is no unevenness of printing quality such as gloss can be obtained.

<Second Embodiment>

In a second embodiment of the present invention, explanation is made regarding a method in which, when the PID control is inhibited for the predetermined time period and the electric power applied to the fixing heater 16 is corrected to the predetermined electric power and the corrected electric power is applied before and after the timing for rushing the recording material P into the fixing nip portion upon the starting of the sheet passing, a recording material P having special heat transfer characteristics from the fixing apparatus and special heat capacity is detected by a media sensor and, by correcting the electric power to the substantially necessary electric power value in consideration of such heat transfer characteristics and heat capacity, more stable temperature control can be achieved without causing the temperature change due to the waste time of the temperature detection when the recording material P rushes into the fixing nip portion.

In this embodiment, General construction and control of the fixing apparatus is similar to that in the first embodiment. However, the second embodiment differs from the first embodiment in the point that, when the electric power applied to the fixing heater 16 is corrected to the predetermined electric power, the applied electric power is corrected to the substantially necessary electric power value in consideration of the heat transfer characteristics and heat capacity of the special recording material having the special heat transfer characteristics from the fixing apparatus and the special heat capacity.

A construction of an image forming apparatus is similar to that in the first embodiment and is as shown in FIG. 1. Further, a construction of a fixing apparatus is similar to that in the first embodiment and is as shown in FIGS. 2, 3 and 4A to 4C, and duplicate explanation will be omitted.

In a recording material referred to as so-called rough paper in which smoothness of the surface of the recording material P is worse and a recording material of film type such as OHT, since the heat transfer characteristics from the fixing apparatus to the recording material P and the heat capacity are differentiated, even when the fixing condition is the same, the electric power required when corrected to the predetermined electric power is differentiated.

The reason is that, regarding the recording material having substantially the same basis weight, since the rough paper has less heat transfer characteristics due to worse surface smoothness in comparison with the conductivity of heat in a general smooth paper and since the recording material of film type such as OHT has great heat capacity due to good surface ability and difference in material, a greater heat amount is required in the fixing.

In order to perform more accurate temperature control, when the electric power applied to the fixing heater is corrected to the predetermined electric power, it is effective to correct the electric power to substantially necessary electric power value in consideration of the heat transfer characteristics and heat capacity of the recording material having the special heat transfer characteristics from the fixing apparatus and special heat capacity. Thus, by discriminating difference in media by using a media sensor 51, the electric power is corrected to the substantially necessary electric power value in consideration of the heat transfer characteristics and the heat capacity.

Figure 8:
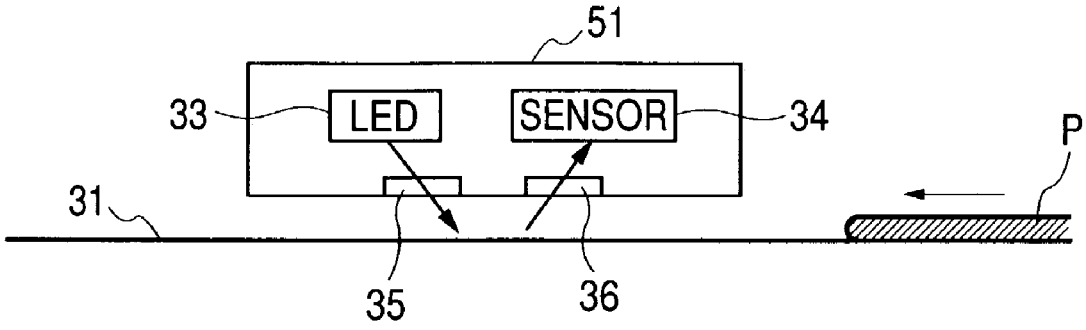
FIG. 8 is a schematic constructional view showing a media sensor.

FIG. 8 is a schematic constructional view of the media sensor 51. The media sensor 51 includes an LED 33 as a light source, a CMOS sensor 34 as reading means, and lenses 35 and 36 as a focusing lens system. Light from the LED 33 as the light source is illuminated onto a recording material conveying guide 31 or the surface of the recording material P on the recording material conveying guide 31 through the lens 35. A reflected light is collected by the lens 36 and is focused on the CMOS sensor 34. In this way, an image of the surface of the recording material conveying guide 31 or the recording material P is read. Whereby, a surface condition of paper fibers of the recording material P is read-in and an analogue signal therefrom is A/D-converted to obtain digital data. Gain operation and filter operation of the digital data are processed by a control processor (not shown) in a programmable manner. Then, image comparison operation is performed and a paper kind is judged on the basis of the image comparison operation result.

In this embodiment, when the electric power applied to the fixing heater 16 is corrected, by detecting, by means of the media sensor 51, the fact that the recording material is the rough paper or the recording material of film type such as OHT, the electric power is corrected to the substantially necessary electric power in consideration of the heat transfer characteristics and the heat capacity of the recording material P. Here, regarding the predetermined electric power value in the first embodiment, even in the same paper mode, if the recording material is the rough paper or the recording material of film type such as OHT, a different correction value is used.

A relationship between the paper modes and applied electric powers for sheet passing in this embodiment is shown in the following Table 4.

TABLE 4

Relationship between paper modes and applied electric powers for sheet passing in the illustrated embodiment

| paper mode | basis weight ($g/m^2$) | applied electric powers for sheet passing E2 (W) | | |
|---|---|---|---|---|
| | | smooth paper | rough paper | film media |
| thin paper | 50 to 60 | 230 | 200 | 250 |
| normal paper | 61 to 105 | 275 | 240 | 300 |
| thick paper 1 | 106 to 128 | 300 | 260 | 330 |
| thick paper 2 | 129 to 176 | 310 | 265 | 340 |

In the case where the recording material is a medium having general heat transfer characteristics and heat capacity, values shown in "smooth paper" in the Table 4 is used.

In the case where the recording material is the rough paper, as shown in the Table 4, the correction value is made smaller in comparison with the general smooth paper and, in the case where the recording material is the recording material of film type (film media) such as OHT, the correction value is made greater in comparison with the general smooth paper.

Next, the actual correction operation in this embodiment will be explained.

Figure 11:
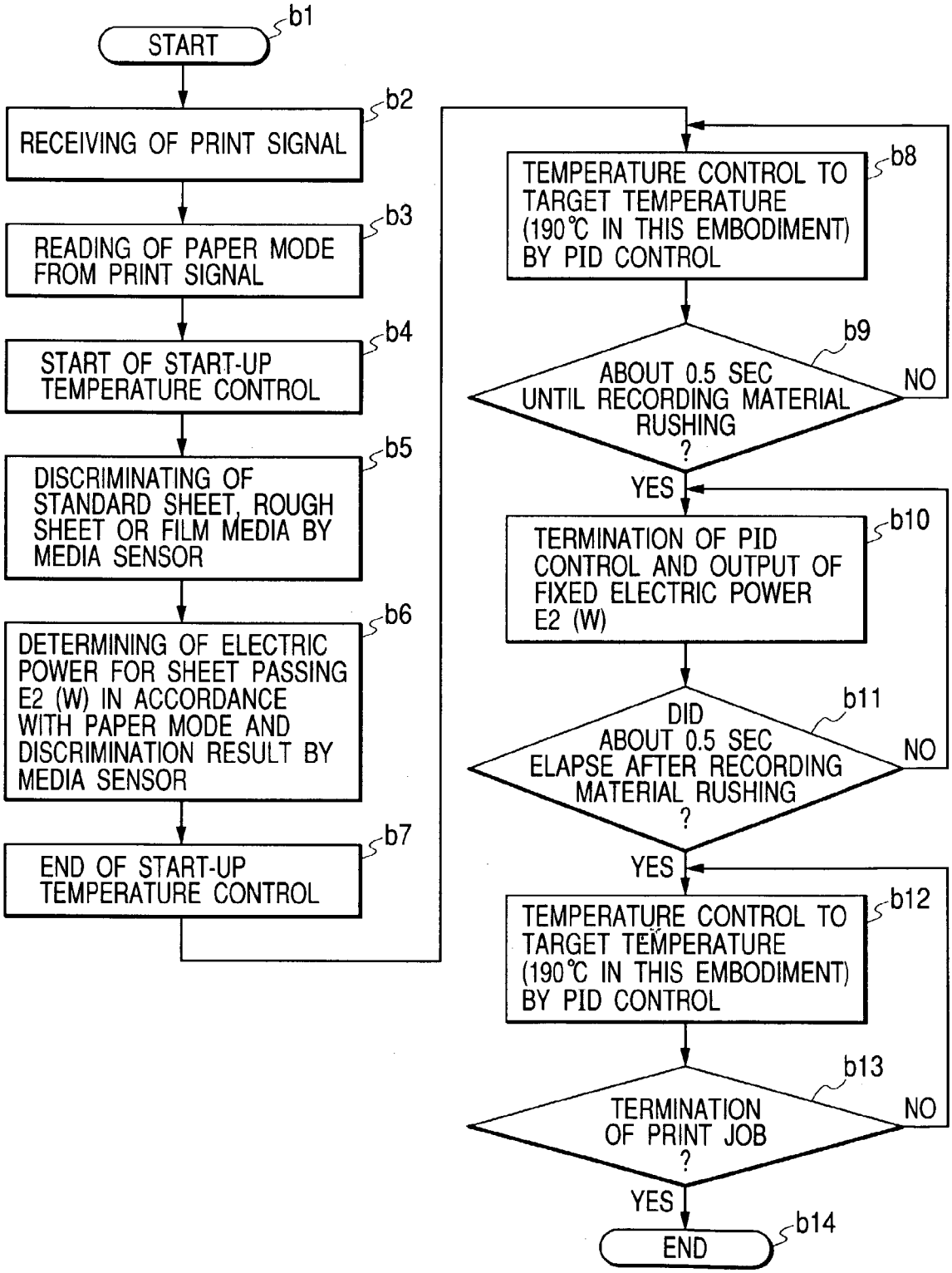
FIG. 11 is a flow chart showing a method for correcting an electric power to be substantially the same as a necessary electrical power value required for a fixing heater 16 in consideration of a heat transferring ability of a specific recording material P detected by using a media sensor, in which the heat transferring ability of the recording material from the fixing apparatus is special.

FIG. 11 shows a flow chart of the method in which, when the PID control is inhibited for the predetermined time period and the electric power applied to the fixing heater 16 is corrected to the predetermined electric power and the corrected electric power is applied before and after the timing for rushing the recording material P into the fixing nip portion upon the starting of the sheet passing, the recording material P having the special heat transfer characteristics from the fixing apparatus and the special heat capacity is detected by the media sensor and the necessary electric power value required for the fixing heater 16 in consideration of such heat transfer characteristics and heat capacity is applied, in the second embodiment.

Now, the actual correction operation will be explained on accordance with such a flow chart.

In FIG. 11, after the power supply is turned ON, the image forming apparatus starts-up to a condition capable of receiving the print signal (step b1). When receives print command from the host computer (not shown) (step b2), the paper mode is read from the print signal (step b3). Thereafter, the control circuit portion 21 drives the heater driving circuit 28 to start the start-up temperature control of the heater 21 thereby to temperature-control the fixing belt 20 to the predetermined temperature (step b4). Thereafter, the media sensor 51 judges whether the recording material is the normal paper, rough paper (recording material having low heat transfer characteristics and small heat capacity) or film media (recording material having high heat transfer characteristics and great heat capacity) (step b5). Thereafter, the control circuit portion (CPU) 21 in the printer determines the applied electric power E2 (W) for sheet passing corresponding the paper mode and the property of the recording material (whether the normal paper, rough paper or media film) as shown in the Tables 1 and 4 (step b6). When the fixing belt 20 approaches the predetermined temperature and the start-up temperature control is finished (step b7), 190° C. as the print temperature control temperature is set as the target temperature and the temperature control is performed by the PID control to achieve the target temperature (step b8). Thereafter, waiting is executed while driving and temperature-controlling the fixing apparatus till about 0.5 second before the recording material rushes into the fixing nip portion (step b9).

When about 0.5 second before the recording material rushes into the fixing nip portion is detected (step b9), the PID control is inhibited and the applied electric power for sheet passing E2 (W) determined in the step b6 is outputted (step b10), and the electric power E2 (W) continues to be applied until about 0.5 second after the recording sheet rushes into the fixing nip portion is elapsed (step b11). Thereafter, 190° C. as the print temperature control temperature is set as the target temperature and the PID control is started again (step b12).

The above-mentioned operations are continued until the print is finished (step b13), and, at the same time when the print job is terminated, the temperature control is ended (step b14).

As mentioned above, when the PID control is inhibited for the predetermined time period and the electric power applied to the fixing heater is corrected to the predetermined value and the corrected value is applied before and after the timing for rushing the recording material P into the fixing nip portion, by detecting the recording material P having the special heat transfer characteristics from the fixing apparatus and the special heat capacity by means of the media sensor and by correcting the electric power to the substantially necessary electric power value in consideration of the heat transfer characteristics and the heat capacity, the change in temperature of the fixing belt associated with the recording material P rushing due to waste time of the temperature detection is not generated, thereby permitting more stable temperature control.

Next, in order to indicate stability of the temperature behavior and effect of image quality improvement in the second embodiment while comparing with the conventional example and the first embodiment, the temperature behavior of the fixing apparatus was measured under the following conditions and the fixed image was ascertained.

The fixing apparatus is rotated at a process speed of 87 mm/sec and the detection temperature of the main thermistor is temperature-controlled to be constant value of 190° C. and sufficient time is elapsed. In this condition, rough media (Fox River Bond (Fox River; goods name)) having a basis weight of 75 g/m$^2$ and film media (color laser glossy film GF-2 (sold by Canon Sales; goods name)) having a basis weight of 166 g/m$^2$ were passed continuously (16 sheets per minute).

In this case, as the temperature of the inner surface of the fixing sleeve 20, the temperature measurement value of the main thermistor 18 was recorded.

Further, regarding the electric power, measurement was performed by A/D-converting output of the electric power value through WT 200 DIGITAL POWER METER (manufactured by YOKOGAWA) by means of a PC temperature recorder NR250 (manufactured by Keyence Inc.) and by taking the converted value into a PC.

The electric power applied before the sheet passing is substantially the same in the respective conditions and is about 80 W.

The temperature ripples before and after the sheet passing in the fixing apparatus of the comparative example 1 and in the first embodiment and the second embodiment are shown in the following Table 5.

TABLE 5

Temperature ripples before and after sheet passing in the conventional example and first and second embodiments

| | Temperature ripples (° C.) | |
|---|---|---|
| | Fox River Bond | GF-2 |
| Comparative example 1 | 16 | 19 |
| First embodiment | 9 | 9 |
| Second embodiment | 6 | 7 |

As can be seen from the Table 5, by performing this embodiment, further stable temperature control (temperature ripple of about 7° C.) could be achieved.

The reason is based on the following grounds.

In the fixing apparatus well warmed, regarding Fox River Bond (75 g/m$^2$), the electric power applied to the fixing heater 16 in a paper mode corresponding to the basis weight is 275 W in the first embodiment. However, this recording material is a recording material having low heat transfer characteristics and small heat capacity, called as a rough paper, and since the heat amount given to the recording material becomes small in comparison with the normal smooth paper, a relative excessive electric power condition is generated when the predetermined electric power is applied. Thus, when the recording material P rushes into the fixing nip portion, the temperature increase is caused and the temperature ripple becomes greater in comparison with the general smooth paper.

In the second embodiment, by discriminating the rough paper, the electric power applied before and after the recording material conveys into the fixing nip portion is set to be a small value in consideration of the nature of the rough paper such as low heat transfer characteristics and small heat capacity, the temperature increase upon the recording material P conveying into a nip region is suppressed, there by reducing the temperature ripple.

In the recording material of film type such as OHT, the same effect can be achieved by correction in a direction opposite to the rough paper.

As such, in the illustrated embodiment, in the case where the recording material is the rough paper and the media film such as OHT, by correcting the predetermined electric power value applied when the recording material rushes into the fixing nip portion in accordance with the detection result of the media sensor, the stable temperature control (temperature ripple of about 7° C.) could be achieved.

Incidentally, in the illustrated embodiment, while an example that the applied electric power is altered in accordance with the discrimination of the rough paper and the film type recording material such as OHT was explained, also regarding a recording material P having special heat transfer characteristics from the fixing apparatus and special heat capacity other than the rough paper, it is possible to determine offset electric power for sheet passing by similar correction.

<Third Embodiment>

In a third embodiment of the present invention, explanation is made regarding a method in which, when the PID control is inhibited for the predetermined time period and the electric power applied to the fixing heater 16 is corrected to the predetermined electric power and the predetermined electric power is applied before and after the timing for rushing the recording material P into the fixing nip portion, by correcting the predetermined electric power on the basis of a heat accumulated degree of the fixing apparatus, the temperature change caused when the recording material P rushes into the fixing nip portion is suppressed, thereby achieving more stable temperature control.

In the third embodiment, general construction and control of a fixing apparatus are similar to those in the first and second embodiments. However, the third embodiment is differs from the first and second embodiments in the point that, when the electric power applied to the fixing heater 16 is corrected to the predetermined electric power before and after the timing for conveying the recording material P into the fixing nip portion, the predetermined electric power is corrected to a value obtained in consideration of the heat accumulated degree of the fixing apparatus.

A construction of an image forming apparatus is similar to that in the first embodiment and is as shown in FIG. 1. Further, a construction of a fixing apparatus is similar to those in the first and second embodiments and is as shown in FIGS. 2, 3 and 4A to 4C, and duplicate explanation will be omitted.

When the electric power applied to the fixing heater 16 is corrected to the predetermined electric power before and after the timing for rushing the recording material P into the fixing nip portion, the predetermined electric power is corrected to substantially necessary electric power in consideration of the heat accumulated degree of the fixing apparatus.

Namely, the electric power required for performing the stable temperature control during the idle rotation is referred to as "idle rotation offset electric power" and the electric power required for performing the stable temperature control for sheet passing of the recording material P is referred to as "predetermined electric power applied for sheet passing".

In this case, the "offset electric power for sheet passing" is defined so that "predetermined electric power applied for sheet passing" equals to "idle rotation offset electric power"+"offset electric power for sheet passing". Further, in this embodiment, the idle rotation offset electric power is varied with the heat accumulated degree of the fixing apparatus.

Optimum values of the idle rotation offset electric power and the offset electric power for sheet passing are varied with the heat accumulated degree of the fixing apparatus. For example, immediately after the fixing apparatus is started-up from the room temperature, the optimum idle rotation offset electric power is about 200 W and, in the fixing apparatus well warmed, the optimum idle rotation offset electric power is about 80 W.

Further, in a case where the paper mode is thick paper 1, the optimum offset electric power for sheet passing is 420 W immediately after the fixing apparatus is started-up from the room temperature and 300 W in the well warmed condition.

In the illustrated embodiment, even in such a case where the electric power applied to the fixing heater 16 differs in accordance with the heat accumulated degree of the fixing apparatus, more precise temperature control can be achieved by correcting the predetermined electric power.

The offset electric powers for sheet passing in the corresponding paper modes in the condition that the fixing apparatus is well warmed in the illustrated embodiment is shown in the following Table 6. In the above-mentioned first embodiment, the fixing apparatus is in the well warmed condition and the idle rotation offset electric power in this case corresponds to 80 W. A value obtained by adding this electric power to the offset electric power for sheet passing shown in the Table 6 is equal to the electric power for sheet passing shown in the Table 1 in the first embodiment.

TABLE 6

Relationship between paper modes and offset electric powers for sheet passing (only normal paper)

| basis weight ($g/m^2$) | paper mode | offset electric powers for sheet passing (W) |
|---|---|---|
| 50 to 60 | thin paper | 150 |
| 61 to 105 | normal paper | 195 |
| 106 to 128 | thick paper 1 | 220 |
| 129 to 176 | thick paper 2 | 230 |

Further, since it is known that the heat accumulated degree of the fixing apparatus depends upon the time period for applying the electric power to the fixing heater started-up from the room temperature, in the illustrated embodiment, the idle rotation offset electric power is changed in accordance with the print count. The print count is a count number corresponding to print sheet number of A4 size papers in the fixing apparatus in a case where the continuous printing is performed after the start-up from the room temperature. It was found that the print count, heater holder temperature and idle rotation offset electric power have a relationship as shown in the following Table 7 in a good reproducible manner.

TABLE 7

Relationship between print sheet number and idle rotation offset electric power

| print count | heater holder (° C.) | idle rotation offset electric power |
|---|---|---|
| 1 | smaller than 55 | 202 |
| 2 | 56 to 69 | 180 |
| 3 | 70 to 89 | 158 |
| 4, 5 | 90 to 119 | 137 |
| 6 to 9 | 120 to 139 | 115 |
| 10 to 25 | 140 to 159 | 104 |
| 25 to 50 | 160 to 179 | 86 |
| greater than 50 | greater than 180 | 80 |

Further, in the illustrated embodiment, after the print job is finished, when the start-up control is performed again in a condition that the heat is accumulated in the fixing apparatus, the heat accumulated degree of the fixing apparatus is estimated in accordance with the detection temperature of the sub thermistor 19 immediately before the electric power is dispatched to the heater 16 and the print count corresponding to the heat accumulating degree of the fixing apparatus is determined, thereby determining the idle rotation offset electric power. Concretely, when the detection temperature of the sub thermistor 19 upon starting of the electric power dispatching is equal to or smaller than 40° C., since it is estimated that the temperature of the heater holder after the start-up is equal to or smaller than 55° C., the print count is set to 1, and, whenever one paper is passed, the count is increased by 1 so that the idle rotation offset electric power is decreased accordingly. Similarly, when the detection temperature before the starting of the start-up is 41 to 55° C., since it is estimated that the temperature of the heater holder is about 60° C., the print count is set to 2. Similarly, when the detection temperature is 56 to 75° C. the print count is set to 3, when the detection temperature is 76 to 95° C. the print count is set to 4, when the detection temperature is 96 to 125° C. the print count is set to 6 and when the detection temperature is greater than 126° C. the print count is set to 10, thereby determining the idle rotation offset electric power.

Figure 12:
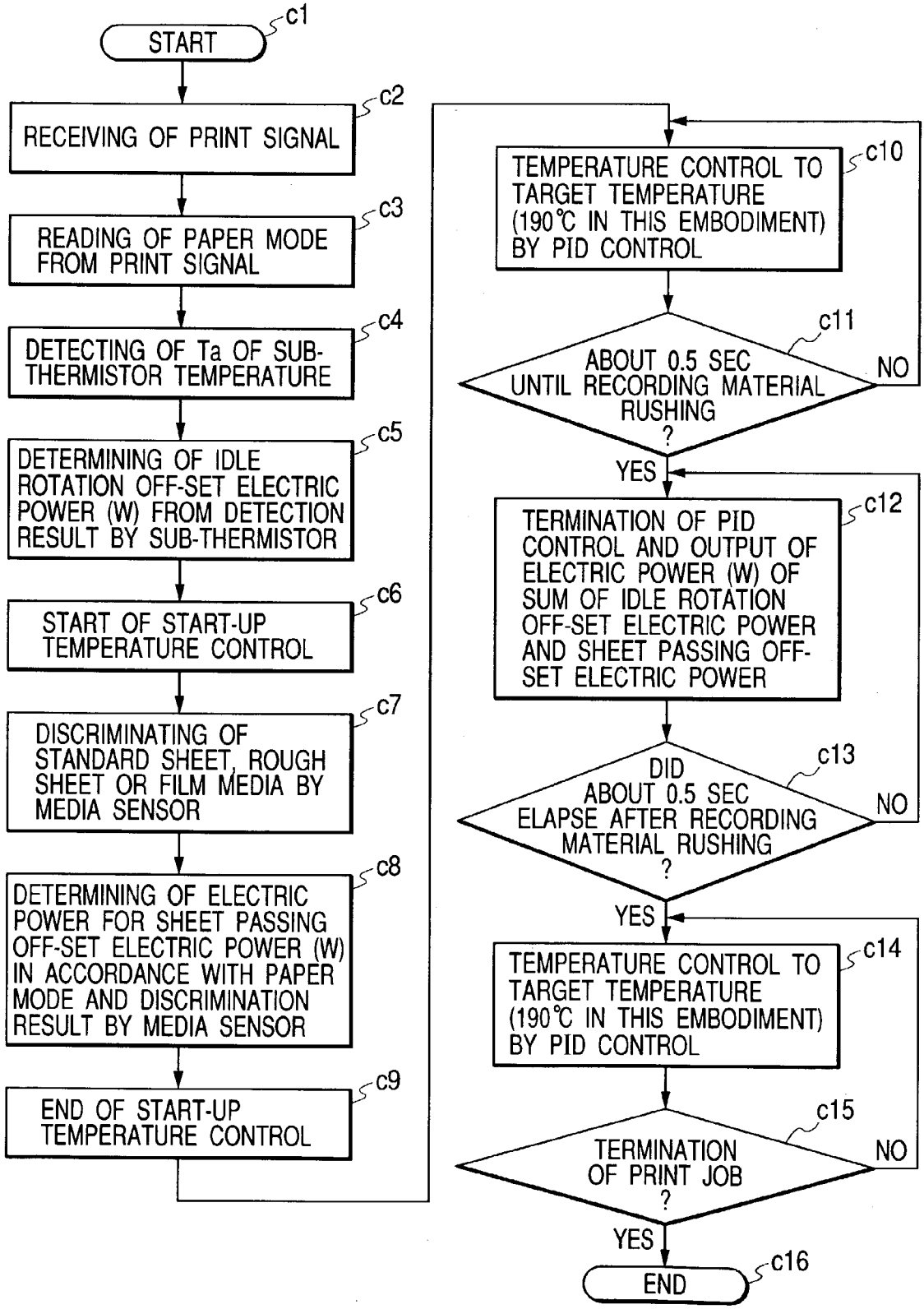
FIG. 12 is a flow chart showing a method for correcting an electric power to be substantially the same as a necessary electrical power value required for a fixing heater 16 in consideration of a heat accumulating degree of the fixing apparatus.

FIG. 12 shows a flow chart of the method in which, when the PID control is inhibited for the predetermined time period and the electric power applied to the fixing heater is corrected to the predetermined value and the corrected value is applied before and after the timing for rushing the recording material P into the fixing nip portion, the electric power is corrected to be substantially the same as the necessary electric power value in consideration of the heat accumulated degree of the fixing apparatus, in the illustrated embodiment.

Now, the actual correction operation will be explained with reference to such a flow chart.

In FIG. 12, after the power supply is turned ON, the image forming apparatus starts-up to a condition capable of receiving the print signal (step c1). When receives print command from the host computer (not shown) (step c2), the paper mode is read from the print signal (step c3). Then, the temperature Ta of the sub thermistor 19 is detected (step c4). The idle rotation offset electric power (W) is determined from this detection temperature Ta in accordance with the Table 7 (step c5). Thereafter, the control circuit portion 21 drives the heater driving circuit 28 to start the start-up temperature control of the heater 21 thereby to temperature-control the fixing belt 20 to the predetermined temperature (step c6). Thereafter, the media sensor 51 judges whether the recording material P is the normal paper, rough paper (recording material having low heat transfer characteristics and small heat capacity) or film media (recording material having high heat transfer characteristics and great heat capacity) (step c7). Thereafter, the control circuit portion (CPU) 21 in the printer determines the applied electric power (W) for sheet passing corresponding to the paper mode and the property of the recording material (whether the normal paper, rough paper or media film) as shown in the Table 6 (step c8). When the temperature of the fixing belt 20 approaches the predetermined temperature and the start-up temperature control is finished (step c9), 190° C. as the print temperature control temperature is set as the target temperature and the temperature control is performed by the PID control to achieve the target temperature (step c10). Thereafter, waiting is executed at the temperature-controlled condition while driving the fixing apparatus till about 0.5 second before the recording material conveys into the fixing nip portion (step c11).

When about 0.5 second before the recording material conveying into the fixing nip portion is detected, the PID control is inhibited and an electric power (W) obtained by adding the idle rotation offset electric power (W) determined in the step c5 to the applied electric power for sheet passing (W) determined in the step c8 is outputted (step c12), and the electric power E2 (W) continues to be applied continuously until about 0.5 second after the recording sheet conveying into the fixing nip portion is elapsed (step c13). Thereafter, 190° C. as the print temperature control temperature is set as the target temperature and the PID control is started again (step c14).

The above-mentioned operations are continued until the print is finished (step c15), and, at the same time when the print job is terminated, the temperature control is ended (step c16).

As mentioned above, by correcting the electric power to the substantially necessary electric power value in consideration of the heat accumulated degree of the fixing apparatus when the PID control is inhibited for the predetermined time period and the electric power applied to the fixing heater is corrected to the predetermined value and the corrected value is applied before and after the timing for conveying the recording material P into the fixing nip portion, the change in temperature of the fixing belt associated with the recording material P rushing due to waste time of the temperature detection is not generated, thereby permitting more stable temperature control.

In the illustrated embodiment, since the electric power for sheet passing can be determined accurately under wide conditions from the room temperature condition of the fixing apparatus to the high temperature condition during endurance, more stable temperature control can be performed.

In this way, the stable temperature control (temperature ripple of about 7° C.) can be achieved regardless of the heat accumulated degree of the fixing apparatus.

As mentioned above, in the illustrated embodiment, by correcting the electric power to the substantially necessary electric power value in consideration of the heat accumulated degree of the fixing apparatus when the PID control is inhibited for the predetermined time period and the electric power applied to the fixing heater is corrected to the predetermined value and the corrected value is applied before and after the timing for rushing the recording material P into the fixing nip portion, the change in temperature of the fixing belt associated with the recording material P rushing due to waste time of the temperature detection is not generated, thereby permitting more stable temperature control.

In this way, by reducing the temperature ripple, the correct temperature control of the fixing member is performed, with the result that the good fixing ability can be obtained, whereby a high quality image which does not generate a poor image that would be caused if the fixing temperature control temperature is improper and in which there is no unevenness of printing quality such as gloss can be obtained.

<Fourth Embodiment>

In a fourth embodiment of the present invention, explanation is made regarding a method in which, when the PID control is inhibited for the predetermined time period and the electric power is corrected to the predetermined electric power and the corrected electric power is applied before and after the timing for rushing the recording material P into the fixing nip portion, by correcting the electric power to the substantially necessary electric power in consideration of a difference in water content of the recording material P measured by using an environmental sensor, the temperature change of the fixing belt is not generated when the recording material P conveys into the fixing nip portion, thereby permitting more stable temperature control.

In this embodiment, general construction and control of a fixing apparatus are similar to those in the third embodiment. However, the fourth embodiment is differs from the third embodiment in the point that, when the electric power applied to the fixing heater 16 is corrected, the electric power is corrected to the substantially necessary electric power in consideration of a difference in heat capacity due to an environment left condition of the recording material P.

A construction of an image forming apparatus is similar to that in the first embodiment and is as shown in FIG. 1. Further, a construction of a fixing apparatus is similar to those in the first to third embodiments and is as shown in FIGS. 2, 3 and 4A to 4C, and duplicate explanation will be omitted.

In this embodiment, when the electric power applied to the fixing heater 16 is corrected, by detecting an environment by means of an environmental sensor, the electric power is corrected to the substantially necessary electric power in consideration of a difference in heat capacity due to the environment where the recording material P is left. Regarding a correction electric power, the sum of an idle rotation offset electric power component and an offset electric power component for sheet passing is regarded as the correction electric power and it is considered that the offset electric power for sheet passing is changed in accordance with a moisture absorbing degree of the recording material P, so that a greater electric power is applied in a high water content environment (for example, H/H (30° C./80%Rh) environment).

Figure 9:
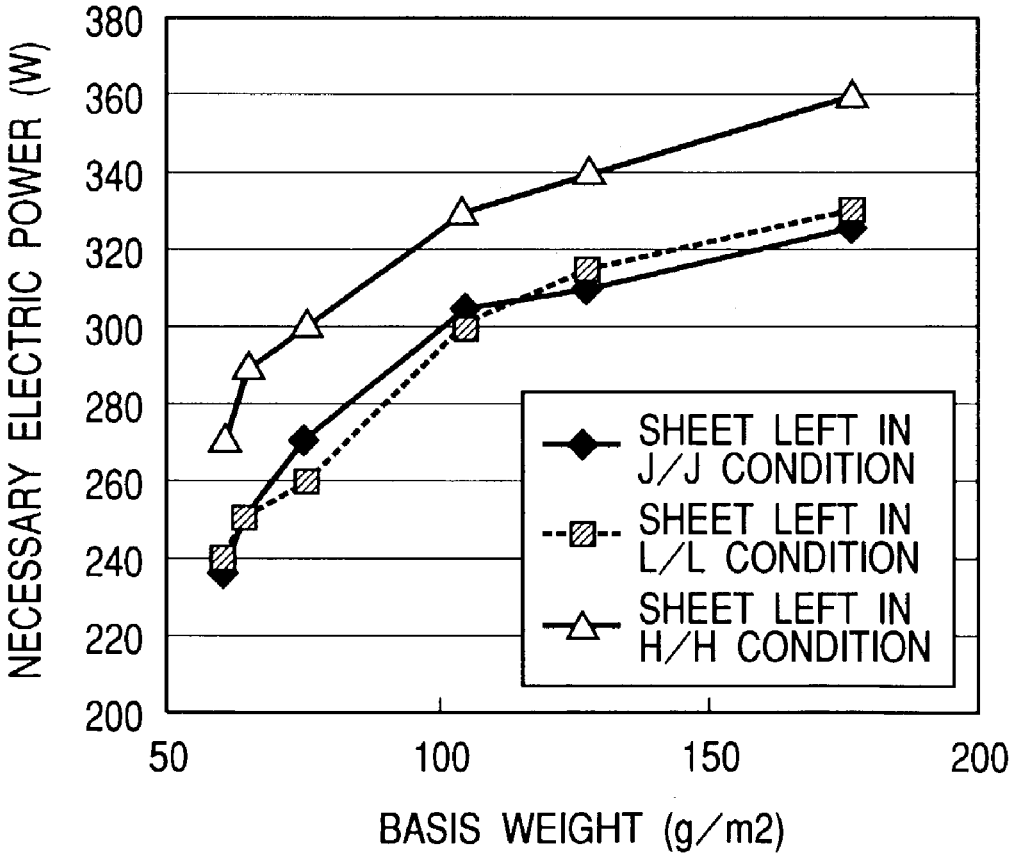
FIG. 9 is a graph showing electric powers required when sheets left in various environments are passed continuously.

FIG. 9 shows electric powers required when left sheets having various basis weights in three kinds of environments are passed continuously. Conditions are as follows. A process speed is 87 mm/sec and measurement was performed in a condition that a sufficient time under constant temperature control of 190° C. is elapsed. As shown in FIG. 9, in the H/H environment, there was a tendency that the electric powers required for maintaining the temperature and applied to the fixing heater 16 upon continuous sheet passing (16 sheets per minute) of environment left papers having various basis weights becomes greater by about 30 W in comparison with papers left in an L/L (15° C., 10%) environment or papers left in a J/J (24.5° C., 45%) environment.

The reason why the electric power applied to the fixing heater 16 upon the continuous sheet passing (16 sheets per minute) in the H/H environment is that, since the paper absorbs the moisture, the heat capacity of the paper is increased.

This embodiment is carried out in order to correspond to the fact that the electric power required for maintaining the temperature applied to the fixing heater 16 upon the continuous sheet passing performed by using high humidity environment left papers is greater in comparison with cases where normal environment left papers or low humidity environment left papers are used.

A relationship between paper modes and offset electric powers for sheet passing in this embodiment is shown in the following Table 8.

TABLE 8

Relationship of offset electric powers for sheet passing (only general paper) also in consideration of high water content environment

| paper mode | basis weight ($g/m^2$) | offset electric powers for sheet passing (W) | |
|---|---|---|---|
| | | normal environment left papers | high humidity environment left papers |
| thin paper | 50 to 60 | 150 | 165 |
| normal paper | 61 to 105 | 195 | 210 |
| thick paper 1 | 106 to 128 | 220 | 235 |
| thick paper 2 | 129 to 176 | 230 | 245 |

Figure 13:
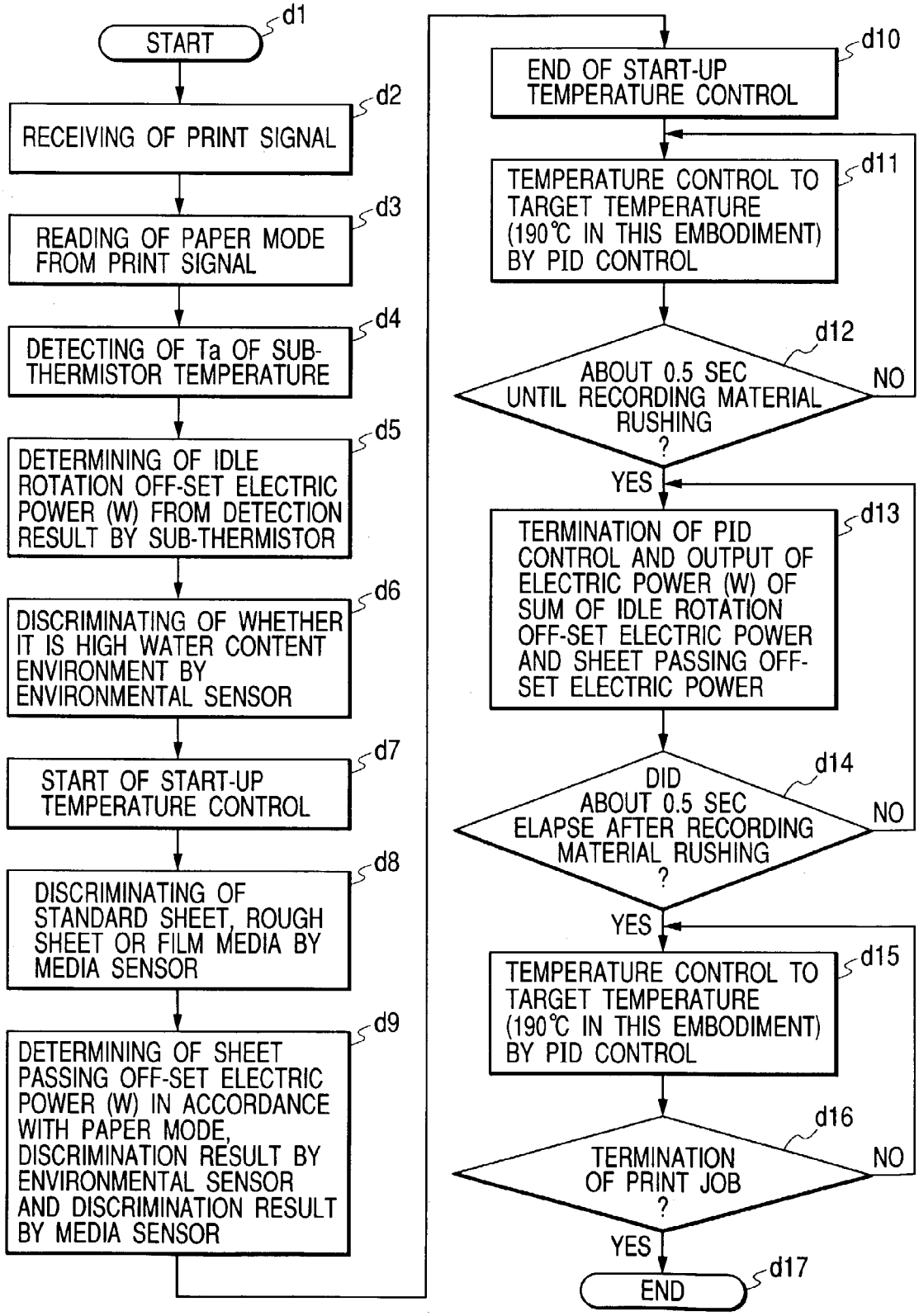
FIG. 13 is a flow chart showing a method for correcting an electric power to be substantially the same as a necessary electrical power value required for a fixing heater 16 in consideration of a difference in environment left condition of the recording material P measured by using an environmental sensor.
Figure 14:
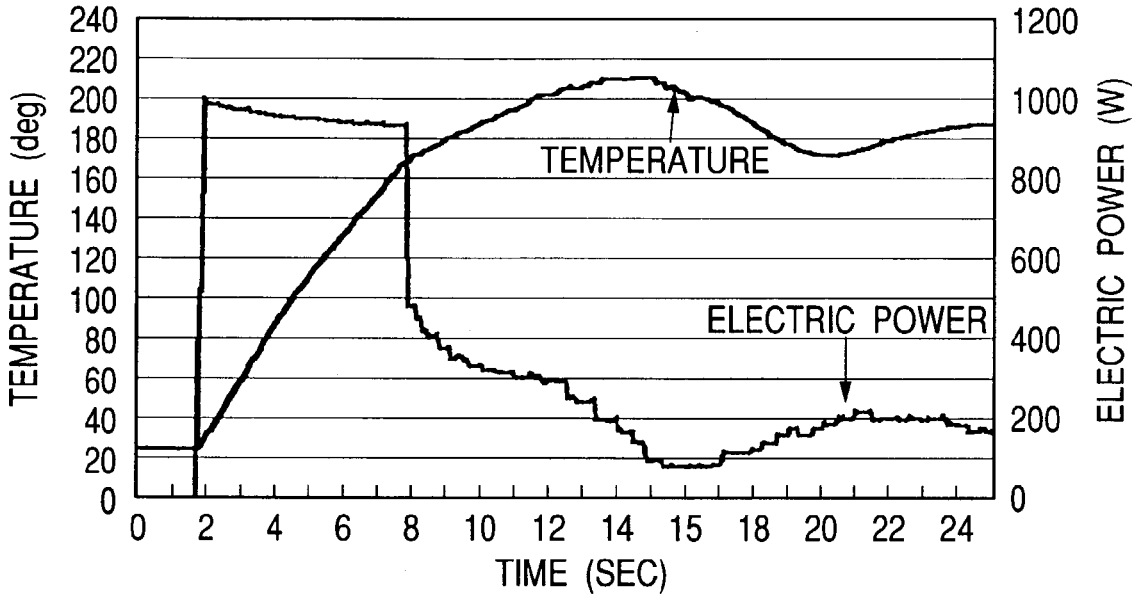
FIG. 14 is a view showing an electric power applied to a fixing heater and a temperature of a fixing belt in start-up temperature control in a conventional fixing apparatus.
Figure 15:
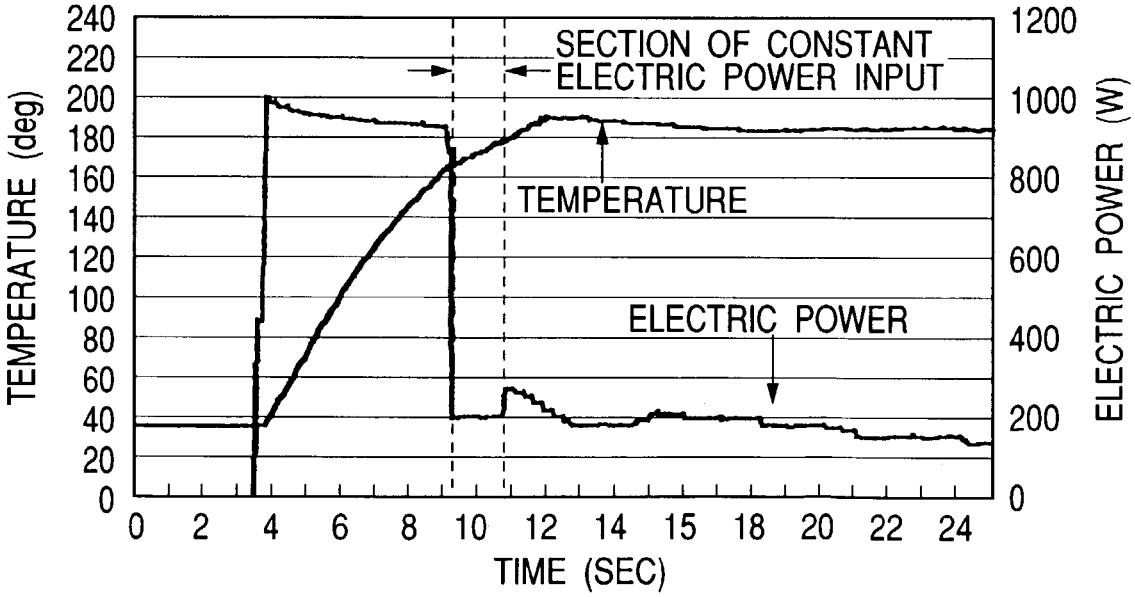
FIG. 15 is a view showing an electric power applied to a fixing heater and a temperature of a fixing belt in start-up temperature control in a fixing apparatus according to a fourth embodiment of the present invention.

FIG. 13 shows a flow chart of a method in which, when the PID control is inhibited for the predetermined time period and the electric power applied to the fixing heater 16 is corrected to the predetermined value and the corrected value is applied before and after the timing for rushing the recording material P into the fixing nip portion, the applied electric power is corrected to become substantially the same as the necessary electric power value required for the fixing heater 16 in consideration of the difference in environment left condition of the recording material P measured by using the environmental sensor.

Now, the actual correction operation will be explained with reference to such a flow chart.

In FIG. 13, after the power supply is turned ON, the image forming apparatus starts-up to a condition capable of receiving the print signal (step d1). When receives print command from the host computer (not shown) (step d2), the paper mode is read from the print signal (step d3). Then, the temperature Ta of the sub thermistor 19 is detected (step d4). The idle rotation offset electric power (W) is determined from this detection temperature Ta in accordance with the Table 7 (step d5). Thereafter, an absolute water amount X (g/kg: water amount in dry air of 1 kg) of an atmospheric environment of the image forming apparatus is calculated by the environmental sensor 50, and, if the absolute water amount is equal to or greater than 21 (g/kg), the environment is judged as a high water content environment; whereas, if not, the environment is judged as a general environment (step d6). Thereafter, the control circuit portion 21 drives the heater driving circuit 28 to start the start-up temperature control of the heater 21 thereby to temperature-control the fixing belt 20 to the predetermined temperature (step d7). Thereafter, the media sensor 51 judges whether the recording material P is the normal paper, rough paper (recording material having low heat transfer characteristics and small heat capacity) or film media (recording material having high heat transfer characteristics and great heat capacity) (step d8). Thereafter, the control circuit portion (CPU) 21 in the printer determines the offset electric power (W) for sheet passing corresponding to the paper mode and the property of the recording material (whether the normal paper, rough paper or media film) as shown in the Tables 6 and 8 and to the atmospheric environment (whether high water content environment or general environment) (step d9). When the temperature of the fixing belt 20 approaches the predetermined temperature and the start-up temperature control is finished (step d10), 190° C. as the print temperature control temperature is set as the target temperature and the temperature control is performed by the PID control to achieve the target temperature (step d11). Thereafter, the fixing apparatus is waiting while being driven and temperature-controlled till about 0.5 second before the recording material rushes into the fixing nip portion is detected (step d12).

When about 0.5 second before the recording material conveys into the fixing nip portion is detected, the PID control is inhibited and an electric power (W) obtained by adding the idle rotation offset electric power (W) determined in the step d5 to the offset electric power for sheet passing (W) determined in the step d8 is applied (step d13), and the electric power continues to be applied until about 0.5 second after the recording sheet rushes into the fixing nip portion is elapsed (step d14). Thereafter, 190° C. as the print temperature control temperature is set as the target temperature and the PID control is started again so that the temperature of the fixing belt 20 is temperature-controlled to the target temperature (step d15).

The PID control is continued until the print is finished (step d16), and, at the same time when the print job is terminated, the temperature control is ended (step d17). In this correction, the control circuit portion (CPU) 21 of the printer is provided with a table (Table 7) for the detection temperature Ta of the sub thermistor 19 and the idle rotation offset electric power (W) and a table (Tables 6 and 8) adapted to determine the offset electric power E2 (W) for sheet passing and having the paper modes, the properties of the recording material (whether normal paper, rough paper or film media) based on the judged result of the media sensor 51 and the atmospheric environments (whether high water content environment or general environment) as parameters, and the correction is performed on the basis of the tables.

As mentioned above, by correcting the electric power to the substantially necessary electric power value in consideration of the difference in environment left condition of the recording material P measured by the environmental sensor when the PID control is inhibited for the predetermined time period and the electric power applied to the fixing heater is corrected to the predetermined value and the corrected value is applied before and after the timing for rushing the recording material P into the fixing nip portion, the change in temperature of the fixing belt associated with the recording material P rushing due to waste time of the temperature detection is not generated, thereby permitting more stable temperature control.

Next, behavior of the temperature of the fixing belt 20 and the effect to the image quality will be explained by comparing with the conventional example and the third embodiment.

The test conditions are as follows.

The fixing apparatus is rotated at the process speed of 87 mm/sec and the detection temperature of the main thermistor 18 is temperature-controlled to be constant at 190° C. and a sufficient time is elapsed. In this condition, as normal smooth papers, office planners (sold by Canon Sales; goods name) having a basis weight of 64 g/m$^2$, and, J/J (24.5° C./45%Rh) environment left papers and H/H (30° C., 80%) environment left papers of media that are New NPI high quality papers 105 g (manufactured by Nippon Seishi CO. Ltd; goods name) having a basis weight of 105 g/m$^2$ are passed continuously (16 sheets per minute).

In this case, the temperature of the inner surface of the fixing sleeve, the output of the main thermistor 18 is monitored.

Further, regarding the electric power, measurement was performed by A/D-converting output of the electric power value through WT 200 DIGITAL POWER METER (manufactured by YOKOGAWA) by means of a PC temperature recorder NR250 (manufactured by Keyence Inc.) and by taking the converted value into a PC.

The electric power applied before the sheet passing is substantially the same in the respective conditions and is about 80 W.

The temperature ripples before and after the sheet passing in the conventional apparatus and in the third embodiment and the fourth embodiment are shown in the following Table 9.

TABLE 9

Temperature ripples before and after sheet passing in the conventional fixing apparatus and third and fourth embodiments

| | Temperature ripples (° C.) | | | |
|---|---|---|---|---|
| | J/J environment left papers | | H/H environment left papers | |
| | Office plan | NPI high quality papers | Office plan | NPI high quality papers |
| Comparative example 1 | 17 | 20 | 18 | 21 |
| Third embodiment | 6 | 7 | 7 | 9 |
| Fourth embodiment | 7 | 7 | 7 | 7 |

As can be seen from the Table 9, by performing this embodiment, further stable temperature control (temperature ripple of about 7° C.) could be achieved.

The reason is based on the following grounds.

In the idle rotation of the well warmed fixing apparatus before the sheet passing, the electric power required for maintaining the temperature is about 80 W and, in the J/J (24.5° C., 45%), in a case where the paper mode is normal paper (61 to 105 g/m$^2$) when the electric power correction is performed by using the offset electric power for sheet passing in this paper mode, the applied electric power is 275 W (80+195 W). On the other hand, when the continuous sheet passing (16 sheets per minute) is performed with NPIs (105 g/m$^2$) which are H/H (30° C., 80%) environment left papers, since the heat capacity of the recording material is great, the electric power maintaining the temperature of the fixing apparatus becomes greater in comparison with the case where the J/J environment left papers are used, and the temperature ripple is generated due to a difference therebetween.

In the illustrated embodiment, the applied electric power is 275 W in an environment which is not a high water content environment; whereas, in the H/H environment which is the high water content environment, the electric power of 290 W (80+210 W) is applied.

By the above control, since the proper electric power correction can always be performed regardless of the left environment of the recording material, the temperature control with desired temperature ripple (about 7° C.) could be achieved.

As such, in the illustrated embodiment, by correcting the electric power applied when the recording material rushes into the fixing nip portion, in consideration of the difference in environment left condition of the recording material P, the stable temperature control (temperature ripple of about 7° C.) can be achieved.

Incidentally, in the high water content environment such as the H/H environment, the offset electric power for sheet passing in the paper mode is changed. In this case, even if the electric power required in the media corresponding to the paper mode may not be precisely coincided but may be substantially the same, and the temperature change in this case may be within the desired temperature ripple.

Generally, in a case where the print speed is fast, since the difference in proper offset electric power for sheet passing due to the difference in the moisture absorbing amount of the recording material P becomes further great, in the high water content environment, it may be required that a newly opened paper and a left paper be discriminated. In such a case, by discriminating the newly opened paper and the left paper by utilizing transferring bias information upon the transferring onto the recording material P, the temperature control within the desired temperature ripple can be achieved.

As mentioned above, in the illustrated embodiment, when the PID control is inhibited for the predetermined time period and the electric power applied to the fixing heater 16 is corrected to the predetermined electric power and the corrected electric power is applied before and after the timing for conveying the recording material P into the fixing nip portion, by correcting the electric power to the substantially necessary electric power in consideration of the difference in environment left condition of the recording material P measured by the environmental sensor, the change in temperature of the fixing belt associated with the recording material P rushing is not generated, thereby permitting more stable temperature control.

In this way, by reducing the temperature ripple, the correct temperature control of the fixing member is performed, with the result that the good fixing ability can be obtained, whereby a high quality image which does not generate a poor image that would be caused if the fixing temperature control temperature is improper and in which there is no unevenness of printing quality such as gloss can be obtained.

<Fifth Embodiment>

In a fifth embodiment of the present invention, explanation is made regarding a method in which, not only upon the sheet rushing, but also in the pre-rotation, a period for applying the fixed electric power is provided so that the temperature ripple during the pre-rotation is reduced, thereby ensuring more stable fixing performance.

(1) Example of Image Forming Apparatus

In this fifth embodiment, a construction of an image forming apparatus is similar to that in the first embodiment and is as shown in FIG. 1, and duplicate explanation will be omitted.

(2) Fixing Apparatus 12

In this embodiment, a construction of a fixing apparatus is similar to those in the first to third embodiments and is as shown in FIGS. 2, 3 and 4A to 4C, and duplicate explanation will be omitted.

(3) Start-Up Temperature Control of Fixing Apparatus

Figure 18:
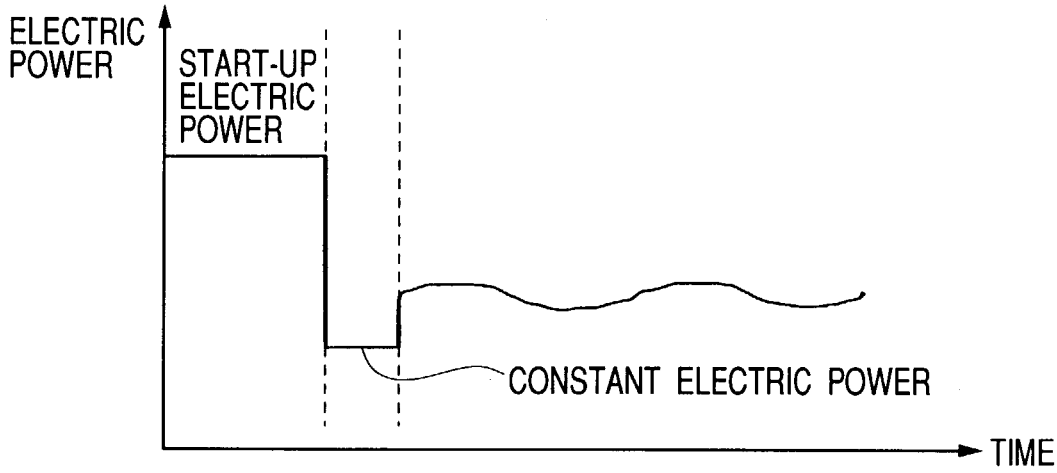
FIG. 18 is a view showing start-up electric power control in the fixing apparatus according to the fourth embodiment of the present invention.

A control sequence of the fixing apparatus according to this embodiment will be explained with reference to FIG. 18. In the illustrated embodiment, the start-up temperature control is performed as follows.

That is to say, "start-up electric power (first electric power lever) output"→"predetermined temperature detection"→"constant electric power (second electric power lever) applying"→"PID control".

In the "start-up electric power (first electric power lever)", in order to ensure the on-demand property, the electric power of 1000 W is applied to the fixing heater 16. As the pressurizing roller 22 is rotated, the fixing belt 20 is heated by the fixing heater 16 while being rotatingly driven. In the illustrated embodiment, after the "start-up electric power (1000 W)" is applied, the "PID control" is not performed immediately, but, when the detection temperature of the main thermistor 18 reaches a predetermined temperature (target temperature −20° C.: in the illustrated embodiment, since the target temperature is 190° C., the predetermined temperature becomes 190° C.−20° C.=170° C.), "predetermined electric power (about 200 W) as the second electric power lever" is applied for about 1.5 second and then, the "PID control" is performed, and thereafter, the electric power applied to the fixing heater 16 is controlled by the "PID control".

Figure 22:
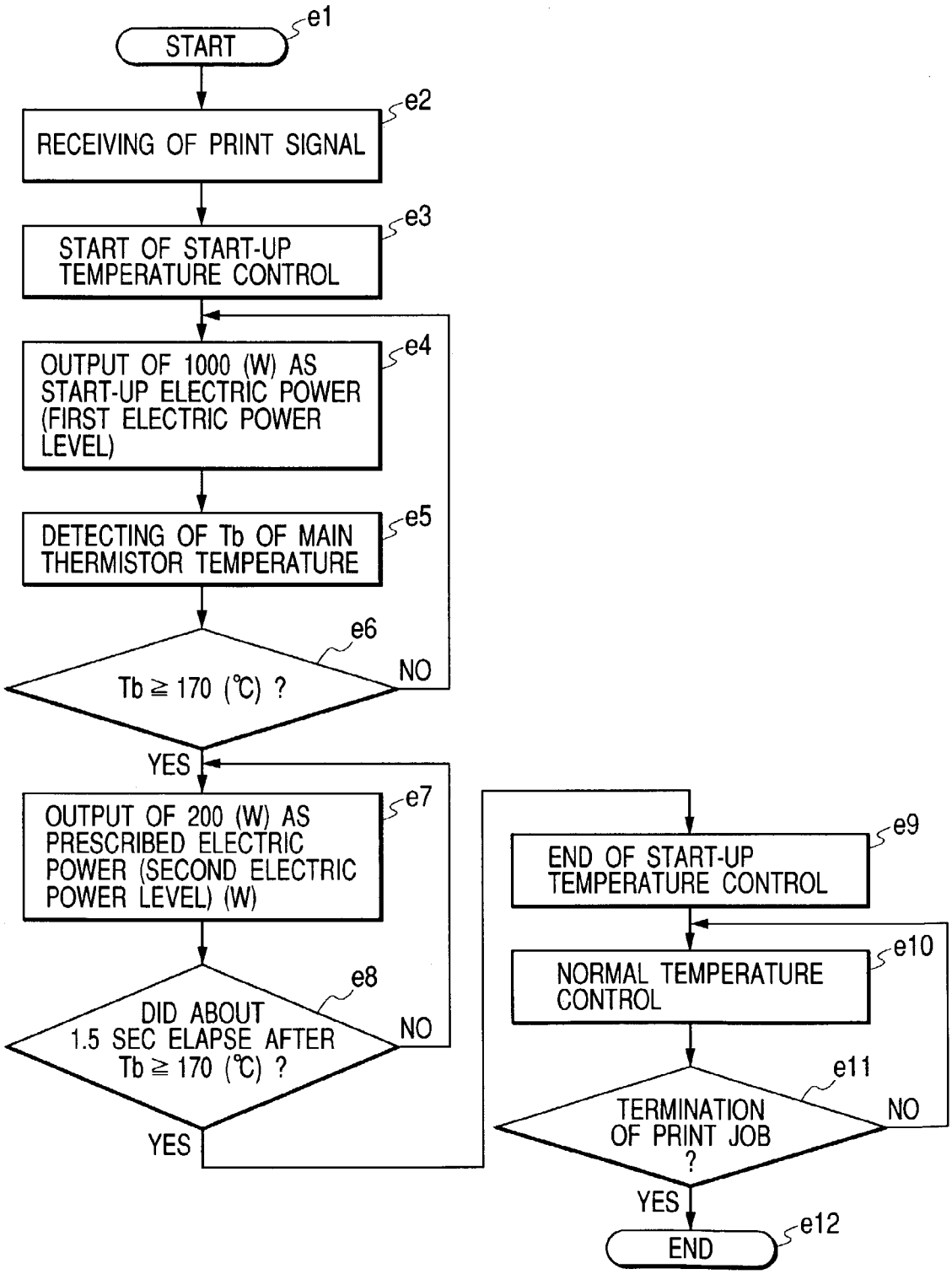
FIG. 22 is a flow chart showing a method for correcting an electric power to be substantially the same as a necessary electrical power value required for a fixing heater 16 in consideration of a difference in environment left condition of the recording material P measured by using an environmental sensor, in a case where, in synchronous with recording material P rushing upon sheet passing, PID control is not performed for a predetermined time period and an electric power to be applied to a fixing heater is corrected to a predetermined value and then is applied.

FIG. 22 shows a flow chart of a method in which there is provided an area where feedback control is inhibited during the start-up temperature control and, in such an area, two stage electric power levels, i.e. a first electric power level for quickly starting-up the temperature of the fixing apparatus and a second electric power level for stabilizing the temperature of the fixing apparatus are used as the electric power applied to the fixing heater 16 and the electric power level is changed after the predetermined temperature is detected during the start-up temperature control.

Now, the actual correction operation will be explained with reference to such a flow chart.

In FIG. 22, after the power supply is turned ON, the image forming apparatus starts-up to a condition capable of receiving the print signal (step e1). When receives print command from the host computer (not shown) (step e2), the control circuit portion 21 drives the heater driving circuit 28 to start the start-up temperature control of the heater 21 thereby to temperature-control the fixing belt 20 to the predetermined temperature (step e3). First of all, as the start-up electric power (first electric power level), an electric power of 1000 W is applied (step e4). Thereafter, the temperature of the main thermistor 18 is monitored (step e5) and the fixing apparatus is waiting while being driven until the detection temperature of the main thermistor 18 reaches the predetermined temperature (target temperature −20° C.: in the illustrated embodiment, since the target temperature is 190° C., the predetermined temperature becomes 190° C.−20° C.=170° C.) (step e6).

At the time when the predetermined temperature is detected by the main thermistor 18, an electric power of 200 W as the predetermined electric power which is the second electric power lever is applied to the fixing heater 16 (step e7). This electric power continues to be applied for about 1.5 second (step e8) and, after 1.5 second is elapsed, the start-up temperature control is terminated (step e9) and the PID control is performed (step e10). Thereafter, control similar to that in the fourth embodiment (similar to the steps d11 to d17 in FIG. 13; represented as "normal temperature control" in FIG. 22) is performed. The above-mentioned operations are continued until the print is terminated (step e11) and, when the print job is terminated, the temperature control is ended (step e12).

As mentioned above, since there is provided the area where feedback control is inhibited during the start-up temperature control and, in such an area, the two stage electric power levels, i.e. the first electric power level for quickly starting-up the temperature of the fixing apparatus and the second electric power level for stabilizing the temperature of the fixing apparatus are used as the electric power applied to the fixing heater 16 and the first electric power level is changed to the second electric power lever after the predetermined temperature is detected during the start-up temperature control, more stable temperature control can be achieved without generating overshoot and temperature ripple.

Next, a temperature profile of the fixing apparatus and measurement results of a fixing ability and gloss in the illustrated embodiment are shown.

Contents of the test are as follows.

1) Testing Method

As the temperature of the inner surface of the fixing belt 20, the output of the main thermistor 18 was monitored.

Further, regarding the electric power, measurement was performed by A/D-converting output of the electric power value through WT 200 DIGITAL POWER METER (manufactured by YOKOGAWA) by means of a PC temperature recorder NR250 (manufactured by Keyence Inc.) and by taking the converted value into a PC.

Regarding the gloss of the fixed image, a glossimeter PG-3D manufactured by Nippon Denshoku Kogyo Co. Ltd was used as a measuring device and measurement was performed by using 75 degree mirror surface gloss measuring method based on JIS Z 8741. Regarding the toner amount on the recording material, the fixing was performed in a condition that a toner amount of a solid image portion of so-called primary colors such as yellow, magenta, cyan and black colors is about 0.5 to 0.6 mg/cm$^2$ and a toner amount of a solid image portion of so-called secondary colors such as red, green and blue colors is about 1.0 to 1.2 mg/cm$^2$, and gloss of the fixed image was measured.

In rubbing test for evaluating the fixing ability, a black solid image having a dimension of 5 mm×5 mm was formed on the recording material P and the fixing was performed at a speed of 16 rpm by using the fixing apparatus according to the illustrated embodiment for 50 sheets continuously, and, thereafter, in a condition that a weight having a weight of 200 g is rested on the imaged surface with the interposition of Sylbon C (goods name), the imaged surface was frictionally slid reciprocally by five times, and reflection density reduction rates (%) were sought before and after the frictional sliding. It is said that the smaller the changing rate of the reflection density (density reduction rate) the better the fixing ability. In the measurement, among 50 recording materials subjected to the fixing, regarding first, second, third, fifth and tenth recording materials, the density reduction rates were measured at nine points on each recording material and the worst values were used.

2) Testing Condition

In the test, the fixing apparatus was started-up from the room temperature. In the fixing apparatus, substantially at the same time when the operation was started, the first electric power (1000 W) was applied to the fixing heater 16 and the electric power continued to be applied when the detection temperature of the main thermistor 18 reached the target temperature of 170° C. (target temperature is (190° C.−20° C.)).

At the time when the detection temperature of the main thermistor reached 170° C., the PID control was inhibited for about 1.5 second and the second electric power (about 200 W) was applied. When 1.5 second was elapsed after the second electric power was applied, the PID control was started again with the start-up target temperature of 190°°C. to temperature-control so that the electric power becomes constant at the target temperature. Thereafter, recording materials having a basis weight of 75 g/m$^2$ and called as Xerox 4024 (goods name) and having a basis weight of 75 g/m$^2$ were passed continuously.

Incidentally, the applied electric power of about 200 W is the electric power required for performing 190° C. temperature control in the idle rotation condition, i.e. electric power value required for maintaining the temperature at the target temperature.

Further, as an endurance test, by using the fixing apparatus according to this embodiment, two-sheet intermittent continuous printing was performed for 150,000 sheets and torque of the pressurizing roller after the continuous printing was measured.

3) Test Results

Figure 19:
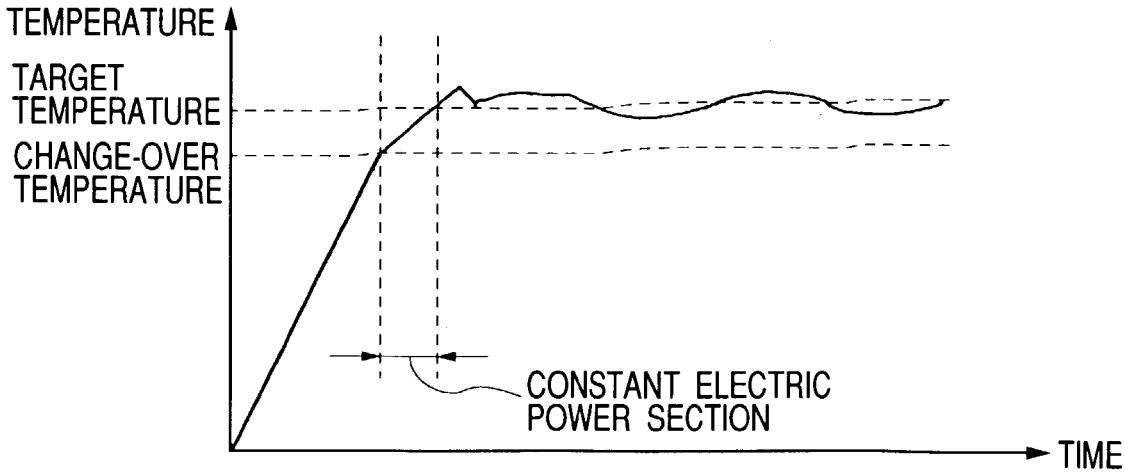
FIG. 19 is a view showing a start-up temperature profile in the fixing apparatus according to the embodiment of the present invention.

FIG. 19 is a graph showing the behavior of the temperature of the inner surface of the fixing belt 20 regarding the electric power applied to the fixing heater 16 at the start-up temperature control in the fixing apparatus according to this embodiment.

As shown in FIG. 19, the stable temperature control (temperature ripple of about 7° C.;±3.5° C. with respect to the target temperature) including overshoot due to the start-up was indicated.

In the case where the temperature ripple is about 7° C., in the electro-photographic color image forming apparatus of in-line type used in the test, the gloss of the outputted print had the change width of about 4 for single color and about 6 for secondary color, which are small (Table 10).

TABLE 10

| | Glosses and their change widths for respective colors in the illustrated embodiment | | |
|---|---|---|---|
| | | Gloss Average | Change widths |
| Single color | Yellow | 13 | 4 |
| | Magenta | 13 | 4 |
| | Cyan | 12 | 4 |
| | Black | 9 | 4 |
| Secondary color | Red | 19 | 6 |
| | Green | 18 | 6 |
| | Blue | 18 | 6 |

Further, as an endurance test, two-sheet intermittent continuous printing was performed for 150,000 sheets by using Letter size Xerox 4024 papers having a basis weight of 75 g/m$^2$. The worst value of the density reduction rate of the fixing ability was 13% and dispersion at various measuring points was small and, stable and good fixing ability could be obtained.

Further, since the fixing can be carried out near the target temperature, regardless of the recording material and the print pattern, a high quality image could be obtained without causing poor fixing such as hot offset.

Furthermore, the driving torque after the endurance test was measured as about 3.0 kgf·cm. In this case, inconvenience of the fixing apparatus could not be found.

(4) COMPARATIVE EXAMPLE 2

Figure 20:
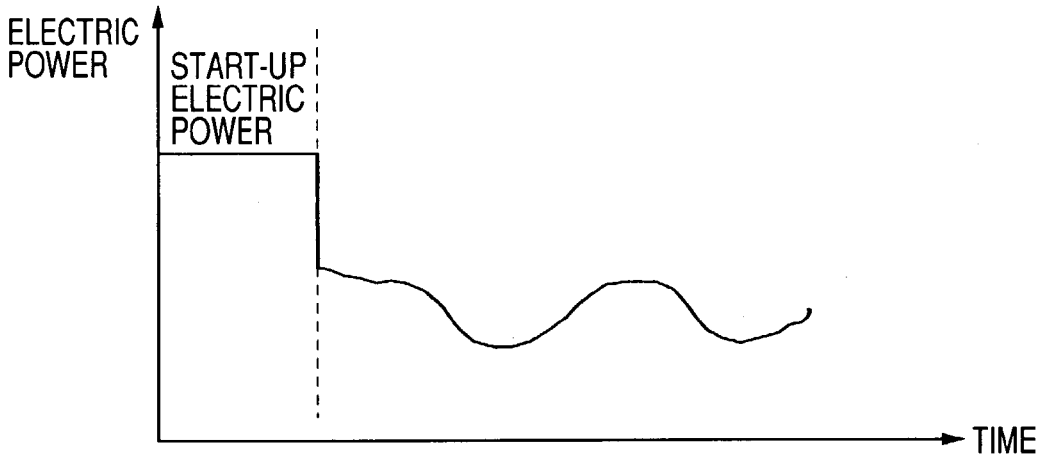
FIG. 20 is a view showing start-up electric power control in the conventional fixing apparatus.

A start-up control sequence in a fixing apparatus according to a comparative example 2 will be explained with reference to FIG. 20.

In this comparative example, the start-up control is performed, in which "start-up electric power (1000 W) output", "predetermined temperature (170° C.) detection" and "PID control" are executed successively. That is to say, a first electric power (1000 W) is applied to the fixing heater 16 and, at the time when the detection temperature of the main thermistor 18 reaches 170° C., the PID control is performed with the start-up target temperature of 190° C. Thus, there is no period for applying a second electric power.

Figure 21:
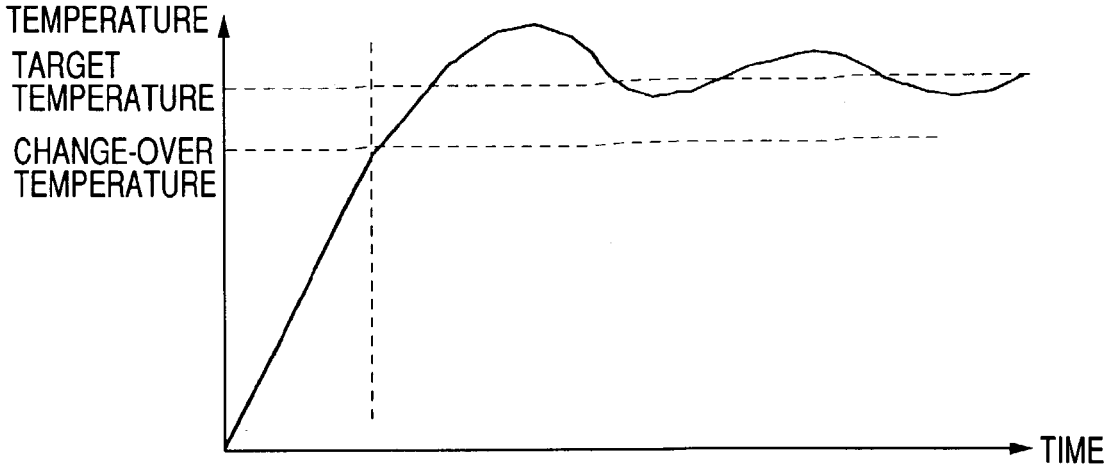
FIG. 21 is a view showing a start-up temperature profile in the conventional fixing apparatus.

In this case, as shown in FIG. 21, the overshoot is generated during the PID control and the temperature ripple caused by the overshoot becomes great.

Next, measurement of the behavior of the temperature of the fixing belt, evaluation of the fixing ability and endurance test result regarding the fixing apparatus according to the comparative example are shown.

1) Testing Method

Since a testing method is the same as that in the fifth embodiment, explanation thereof will be omitted.

2) Testing Condition

In the fixing apparatus at the room temperature, at substantially the same time when the apparatus was operated, the first electric power (1000 W) was applied to the fixing heater 16 and the first electric power continued to be applied until the detection temperature of the main thermistor 18 reached 170° C. Thereafter, the second electric power was not applied and the PID control was executed with the target temperature of 190° C. Thereafter, the continuous sheet passing (16 sheets per minute) was performed by using media (Xerox 4024 (goods name) papers) having a basis weight of 75 g/m$^2$.

Further, the same endurance test as explained in the fifth embodiment was performed.

3) Test Result

FIG. 21 is a graph showing the behavior of the temperature of the rear surface of the fixing belt 20 regarding the electric power applied to the fixing heater 16 at the start-up temperature control in the conventional example.

As shown in FIG. 21, although the temperature of the rear surface of the fixing belt 20 was started-up to the desired temperature by about 9 seconds, thereafter, the overshoot occurred to increase the temperature up to about 210° C. Thereafter, the temperature of the rear surface of the fixing belt 20 was increased and decreased repeatedly and it took about 10 seconds until the temperature was stabilized within the temperature ripple of 7° C. regarding the target temperature of 190° C.

When such overshoot occurred, in the electro-photographic color image forming apparatus of in-line type used in the test, the gloss of the outputted print was changed by about 8 for single color and by about 13 for secondary color in a single outputted paper, thereby worsening the image quality (Table 11).

TABLE 11

| | Glosses and their change widths for respective colors in the comparative example 2 | | |
|---|---|---|---|
| | | Gloss Average | Change widths |
| Single color | Yellow | 13 | 8 |
| | Magenta | 13 | 8 |
| | Cyan | 12 | 8 |
| | Black | 9 | 6 |
| Secondary color | Red | 19 | 13 |
| | Green | 18 | 13 |
| | Blue | 18 | 13 |

Further, the worst value of the density reduction rate was 22%. if the density reduction rate exceeds 20%, when the user uses the image, problems that not only the image is peeled or a half tone image becomes dim but also user's hands and/or cloths and/or other papers are contaminated will occur.

Further, if the paper is passed during the overshoot, poor fixing such as hot offset will occur regardless of the recording material and the printing pattern.

Furthermore, the driving torque of the fixing apparatus after the endurance test was measured as about 4.5 kgf·cm. In this case, depending upon the condition, the slipping of the fixing belt might occur during the operation of the fixing apparatus.

(5) Consideration

First of all, the overshoot and the temperature ripple will be described.

The reason why the effect can be obtained in the illustrated embodiment is as follows. In the conventional fixing apparatus, since heat transfer characteristics of the silicone rubber used in the elastic layer of the fixing belt 20 is low and the heat capacity is great, the temperature response of the fixing belt 20 with respect to the temperature increase of the fixing heater 16 is bad. Further, since the position of the main thermistor 18 is spaced apart away from the fixing heater 16 as the heat generating portion to cause delay in the detection timing, when the temperature is increased quickly as is in the start-up, the detection temperature of the main thermistor 18 shows a value greatly below the temperature of the fixing nip portion. Thus, even when the temperature of the fixing heater 16 is actually increased sufficiently, since the detection temperature of the main thermistor 18 is not increased sufficiently, the great electric power continues to be applied, thereby generating the overshoot.

Further, once the overshoot is generated, after predetermined time lag, the main thermistor 18 detects the fact that the temperature is greater than the desired temperature and, control for suppressing the electric power is performed. In this case, even when the electric power is suppressed to reduce the heat generating amount of the fixing heater 16 thereby to provide the proper temperature of the fixing nip portion, the main thermistor 18 recognizes that the detection temperature is high. Thus, the electric power is suppressed more than it needs, thereby generating undershoot. The repetition of the overshoot and undershoot causes the temperature ripple.

Further, in the fixing apparatus, since the great start-up electric power (1000 W) is used for ensuring the on-demand property in the condition that the fixing belt 20 having worse temperature response is used, immediately after, if the feedback control such as the PID control is restored, the change width of the electric power will become great, which provides unstable control having great temperature change.

Here, after the start-up electric power is applied, when the detection temperature of the main thermistor 18 reaches the predetermined temperature (target temperature −20° C.), by applying a predetermined electric power (about 200 W) for about 1.5 second, the change in electric power caused when the control is shifted to the PID control is made relatively gentle, with the result that the overshoot can be reduced and the temperature ripple due to the overshoot can also be reduced.

Next, endurance of the fixing member will be described.

As is in the conventional example, in the case where, at the start-up, the temperature of the inner surface of the fixing sleeve 20 reaches up to about 210° C., grease existing between the fixing heater 16 and the inner surface of the fixing belt 20 is deteriorated quickly. It is known that a dynamic friction force between the fixing belt 20 and parts or elements such as the fixing heater 16 provided inside of the fixing belt is particularly influenced by the condition of the grease greatly, and, thus, if the amount of the grease is decreased by shifting to other place or if the grease itself is deteriorated, the dynamic friction force is increased.

Thus, when the endurance of the fixing apparatus is advanced, the torque of the fixing apparatus is increased, and, in the worst case, the dynamic friction force between the fixing belt and the elements such as the fixing heater 16 provided inside of the fixing belt exceeds a maximum static friction force between the fixing belt and the pressurizing roller 22 or the recording material P, thereby causing the slip of the fixing belt 20.

The dynamic friction force between the fixing belt 20 and the elements such as the fixing heater 16 provided inside of the fixing belt is a greatest factor among loads acting on the driving means in the operation of the fixing apparatus. Namely, the measured value can be substituted for the driving torque of the fixing apparatus.

The driving torque in the initial condition of the fixing apparatus is about 1.5 kgf·cm and it has been found that the slip of the fixing belt 20 occurs when the driving torque exceeds about 4.0 kgf·cm.

In the fifth embodiment and the comparative example 2, as the representative example for reducing the endurance service life, the slip of the fixing belt 20 is shown. If the overshoot of the fixing apparatus is great, since excessive load acts on the elements disposed within the fixing apparatus, by preventing the overshoot by using the illustrated embodiment, the service lives of the elements disposed within the fixing apparatus can be extended.

Incidentally, the value of the second electric power (about 200 W) explained in the fifth embodiment is an electric power required for maintaining 190° C. temperature control stably in the idle rotation condition of the fixing apparatus and is sought experimentally. However, the electric power applied here may not be coincided with the necessary electric power but may substantially be coincided. That is to say, after the second electric power is applied and the temperature of the fixing apparatus is stabilized, since the great change in electric power is not caused by the PID control, the temperature ripple can be reduced.

As mentioned above, in the illustrated embodiment, since there is provided the area where feedback control is inhibited during the start-up temperature control and, in such an area, the two stage electric power levels, i.e. the first electric power level for quickly starting-up the temperature of the fixing apparatus and the second electric power level for stabilizing the temperature of the fixing apparatus are used as the electric power applied to the fixing heater 16 and the first electric power level is changed to the second electric power lever when the predetermined temperature is detected during the start-up temperature control in which the first electric power is applied, and the feedback control is restored in the condition that the temperature of the fixing apparatus is stabilized, more stable temperature control can be achieved without generating overshoot.

As such, by suppressing the overshoot and the temperature ripple due to the overshoot, the service life of the fixing apparatus can be extended, and, the correct temperature control of the fixing member is performed, with the result that the good fixing ability can be obtained, whereby a high quality image which does not generate a poor image that would be caused if the fixing temperature control temperature is improper and in which there is no unevenness of printing quality such as gloss can be obtained.

<Sixth Embodiment>

In a sixth embodiment of the present invention, explanation is made regarding a method in which more stable temperature control can be achieved without generating the overshoot by correcting the second electric power level on the basis of the detection temperature of the sub thermistor 19 before the start-up, in the fixing apparatus in which there is provided the area where feedback control is inhibited during the start-up temperature control and, in such an area, the two stage electric power levels, i.e. the first electric power level for quickly starting-up the temperature of the fixing apparatus and the second electric power level for stabilizing the temperature of the fixing apparatus are used as the electric power applied to the fixing heater 16 and the first electric power level is changed to the second electric power lever when the predetermined temperature is detected during the start-up temperature control using the first electric power.

In this embodiment, general construction and control of a fixing apparatus are similar to those in the fifth embodiment. However, the sixth embodiment is differs from the fifth embodiment in the point that, when the electric power applied to the fixing heater 16 is corrected, the electric power is corrected to the substantially necessary electric power in consideration of a heat accumulating degree of the fixing apparatus.

A construction of an image forming apparatus is similar to that in the first embodiment and is as shown in FIG. 1. Further, a construction of a fixing apparatus is similar to that in the first embodiment and is as shown in FIGS. 2, 3 and 4A to 4C, and duplicate explanation will be omitted.

In this embodiment, when the second electric power level applied to the fixing heater 16 during the start-up temperature control, the electric power is corrected to the substantially necessary electric power in consideration of a heat accumulating degree of the fixing apparatus.

Namely, after the predetermined temperature is detected during the start-up temperature control, the second electric power level required for maintaining the temperature of the fixing apparatus at the target temperature is changed in accordance with the heat accumulating degree of the fixing apparatus. For example, after the start-up electric power is applied to the fixing apparatus from the room temperature, when the predetermined temperature is detected, since the second electric power level required for maintaining the temperature of the fixing apparatus at the target temperature is about 200 W and, when the well warmed fixing apparatus is started-up, the second electric power level required for maintaining the temperature of the fixing apparatus at the target temperature is about 80 W, in consideration of the heat accumulating degree of the fixing apparatus, the present invention can cope with a situation that the electric power to be applied to the fixing heater 16 is differentiated in accordance with the heat accumulating degree of the fixing apparatus.

In this embodiment, the heat accumulating degree of the fixing apparatus is estimated from the detection temperature of the sub thermistor 19 upon starting of the electric power dispatching.

Figure 16:
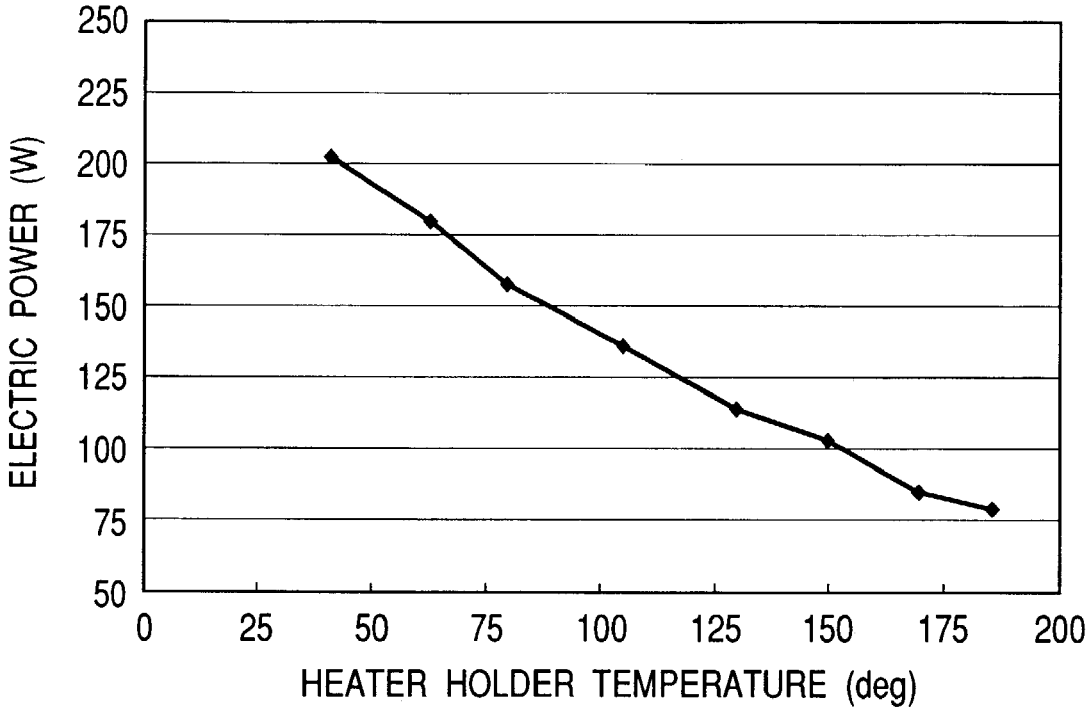
FIG. 16 is a view obtained by plotting a relationship between a temperature of a heater holder and a predetermined electric power value.

FIG. 16 is a graph showing a relationship between the temperature of the heater holder 17 and the value of the electric power required for maintaining the temperature of the fixing apparatus to the predetermined value. As such, the temperature of the heater holder 17 and the value of the electric power required for maintaining the temperature of the fixing apparatus to the predetermined value represent a relationship as shown in FIG. 16 in a reproducible manner.

TABLE 12

| | Relationship between temperature of sub thermistor before start-up and heater holder temperature and predetermined electric power value | | |
|---|---|---|---|
| Start-up | temperature of sub thermistor before start-up (° C.) | heater holder temperature (° C.) | second electric power level (W) |
| 1 | up to 40 | up to 55 | 202 |
| 2 | 41 to 55 | 56 to 69 | 180 |
| 3 | 56 to 75 | 70 to 89 | 158 |
| 4 | 76 to 95 | 90 to 119 | 137 |
| 5 | 96 to 125 | 120 to 139 | 115 |
| 6 | 126 or more | 140 to 159 | 104 |

In this embodiment, after the print job is terminated, when the fixing apparatus is started-up again while waste heat is remaining in the fixing apparatus, the temperature of the heater holder 17 after start-up is estimated in accordance with the detection temperature of the sub thermistor 19 as shown in the Table 12, thereby determining the value of the second electric power level.

More concretely, in a case where the detection temperature of the sub thermistor 19 upon starting of the electric power dispatching is equal to or smaller than 40° C., since is it guessed that the temperature of the heater holder after the start-up is equal to or smaller than 55° C., in "start-up 1", 200 W is used as the value of the second electric power level.

Similarly, in a case where the detection temperatures of the sub thermistor before the start-up are 41 to 55° C., 56 to 75° C., 76 to 95° C. and 96 to 125° C., "start-up 2", "start-up 3", "start-up 4" and "start-up 5" are used, respectively and in a case where the detection temperature is equal to or greater than 126° C., "start-up 6" is used, thereby determining the second electric power level.

Figure 23:
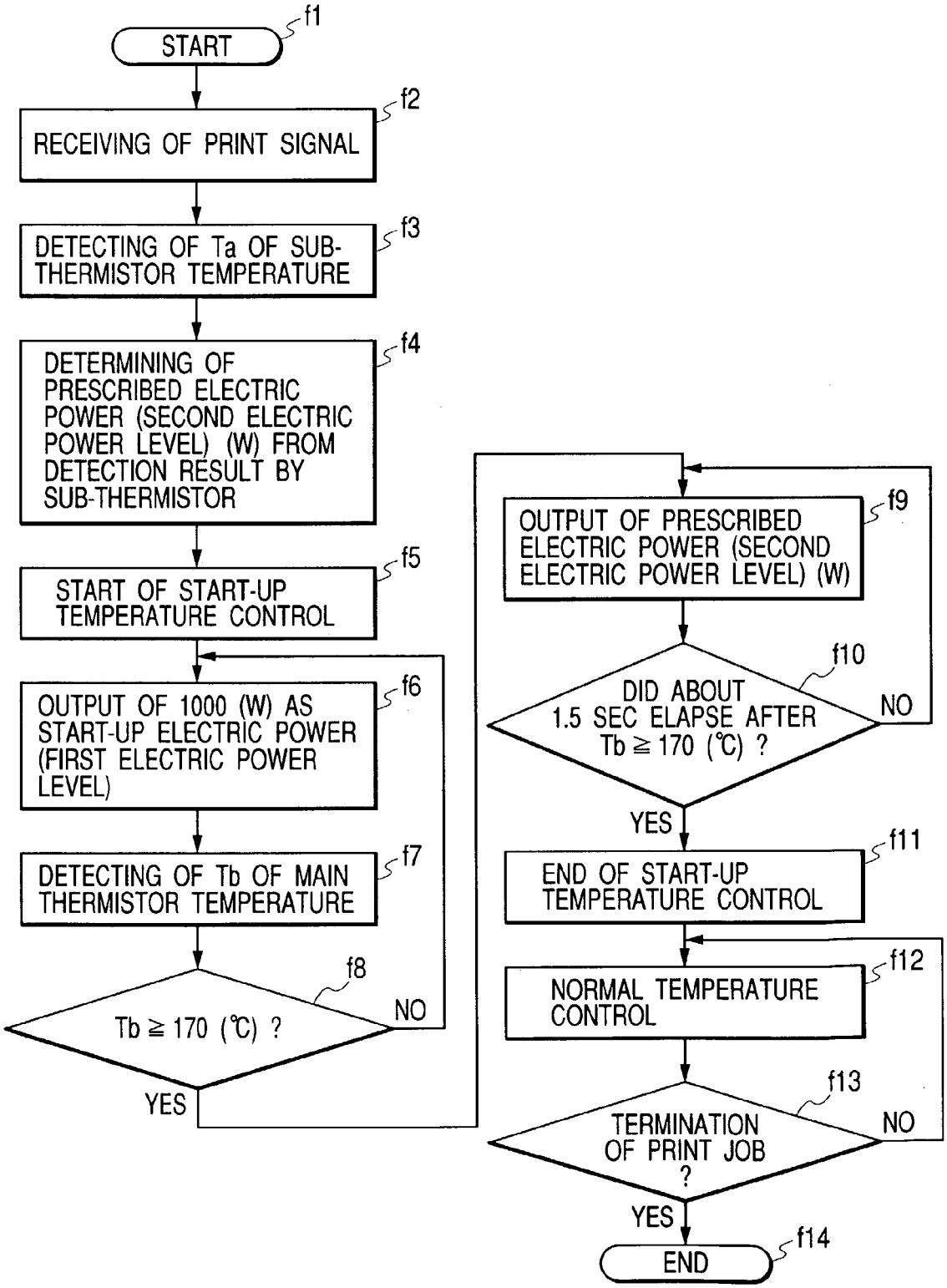
FIG. 23 a flow chart showing a method for correcting an electric power to be substantially the same as a necessary electrical power value required for a fixing heater 16 in consideration of a difference in environment left condition of the recording material P measured by using an environmental sensor.
Figure 24:
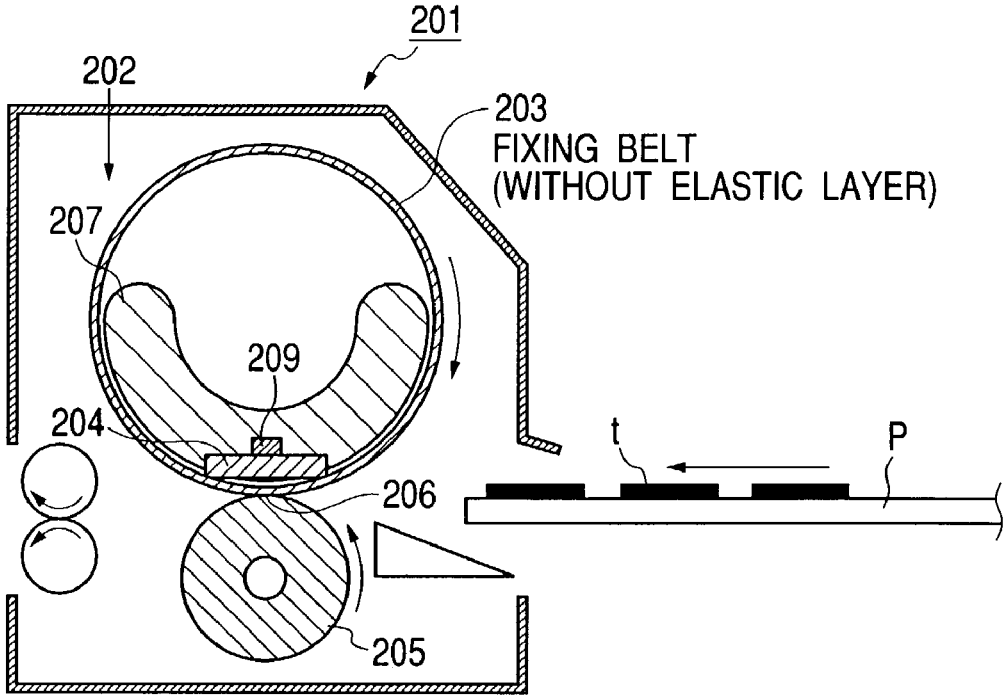
FIG. 24 is a schematic sectional view of a conventional fixing apparatus of belt fixing type.
Figure 25:
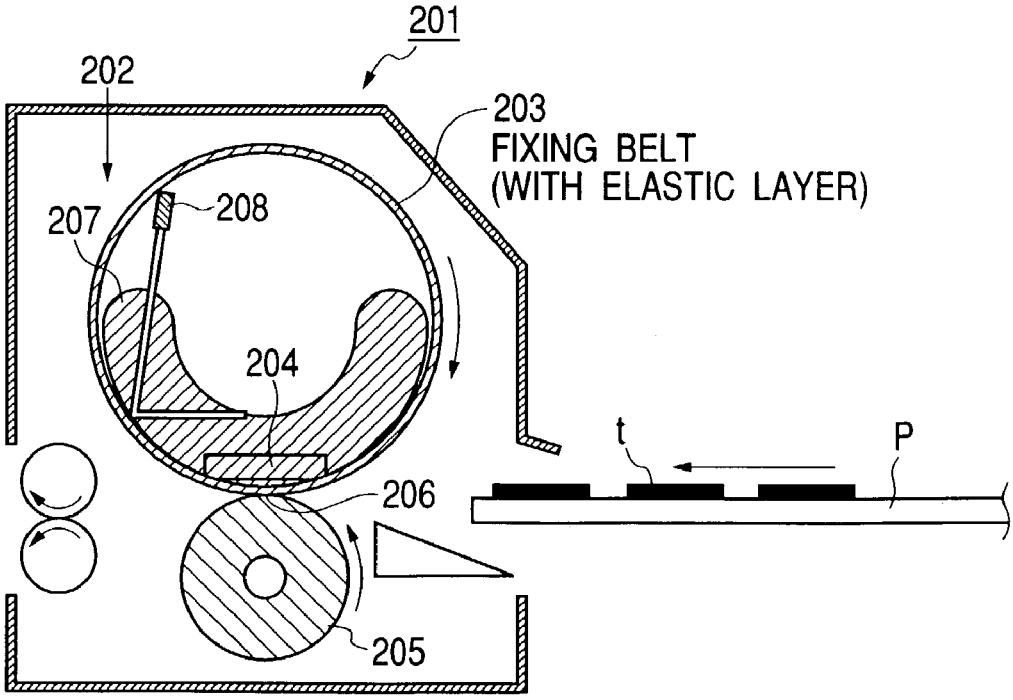
FIG. 25 is a schematic sectional view of a fixing apparatus using a thermistor of fixing belt inner surface abutting type in a conventional belt fixing type.

FIG. 23 shows a flow chart of the method in which there is provided the area where feedback control is inhibited during the start-up temperature control and, in such an area, the two stage electric power levels, i.e. the first electric power level for quickly starting-up the temperature of the fixing apparatus and the second electric power level for stabilizing the temperature of the fixing apparatus are used as the electric power applied to the fixing heater 16 and, when the first electric power level is changed to the second electric power lever when the predetermined temperature is detected during the start-up temperature control, the second electric power level is corrected to the necessary electric power in consideration of the heat accumulating degree of the fixing apparatus on the basis of the detection temperature of the sub thermistor 19 before the start-up.

Now, the actual correction operation will be explained with reference to such a flow chart.

In FIG. 23, after the power supply is turned ON, the image forming apparatus starts-up to a condition capable of receiving the print signal (step f1). When receives print command from the host computer (not shown) (step f2), first of all, the temperature Ta of the sub thermistor is detected (step f3) and the predetermined electric power (second electric power level) (W) is determined from the result of the detection temperature of the sub thermistor in accordance with the Table 12 (step f4). Thereafter, the control circuit portion 21 drives the heater driving circuit 28 to start the start-up temperature control of the heater 21 thereby to temperature-control the fixing belt 20 to the predetermined temperature (step f5). First of all, as the start-up electric power (first electric power level), an electric power of 1000 W is applied (step f6). Thereafter, the temperature of the main thermistor 18 is monitored (step f7) and the fixing apparatus is waiting while being driven until the detection temperature of the main thermistor 18 reaches the predetermined temperature (target temperature −20° C.: in the illustrated embodiment, since the target temperature is 190° C., the predetermined temperature becomes 190° C.−20° C.=170° C.) (step f8).

When the detection temperature of the main thermistor 18 reaches the predetermined temperature, the second electric power level determined in the step f4 is outputted (step f9). After this electric power continues to be applied for about 1.5 second (step f10), the start-up temperature control is terminated (step f11) and the PID control is restored to perform the temperature control with the target temperature (step f12). Thereafter, the normal temperature control (similar to the steps d11 to d17 in FIG. 13) is continued until the print is terminated (step f13) and, when the print job is terminated, the temperature control is ended (step f14).

As mentioned above, since there is provided the area where feedback control is inhibited during the start-up temperature control and, in such an area, the two stage electric power levels, i.e. the first electric power level for quickly starting-up the temperature of the fixing apparatus and the second electric power level for stabilizing the temperature of the fixing apparatus are used as the electric power applied to the fixing heater 16 and, when the first electric power level is changed to the second electric power lever when the predetermined temperature is detected during the start-up temperature control, the second electric power level is corrected to the necessary electric power in consideration of the heat accumulating degree of the fixing apparatus on the basis of the detection temperature of the sub thermistor 19 before the start-up, more stable temperature control can be achieved without generating the overshoot.

Since the effect obtained by using this embodiment is, in principle, the same as that of the first embodiment, explanation thereof will be omitted. However, in this embodiment, since the electric power applied upon the start-up can be determined with high accuracy in fixing apparatuses having various conditions from the fixing apparatus at the room temperature to the well warmed fixing apparatus, further stable temperature control can be achieved.

In this way, the stable temperature control (temperature ripple is within about 7° C.) could be achieved.

As such, by suppressing the overshoot and the temperature ripple due to the overshoot, the service life of the fixing apparatus can be extended, and, the correct temperature control of the fixing member is performed, with the result that the good fixing ability can be obtained, whereby a high quality image which does not generate a poor image that would be caused if the fixing temperature control temperature is improper and in which there is no unevenness of printing quality such as gloss can be obtained.

Further, here, while an example that the temperature of the heater holder is estimated by using the detection temperature of the sub thermistor 19 to determine the predetermined electric power was explained, the sub thermistor may not be used and the temperature of the heater holder may be estimated from the printed sheet number, thereby determining the predetermined electric power.

<Seventh Embodiment>

In a seventh embodiment of the present invention, explanation is made regarding a method in which there is provided the area where feedback control is inhibited during the start-up temperature control and, in such an area, the two stage electric power levels, i.e. the first electric power level for quickly starting-up the temperature of the fixing apparatus and the second electric power level for stabilizing the temperature of the fixing apparatus are used as the electric power applied to the fixing heater 16 and, when the first electric power level is changed to the second electric power lever after the predetermined temperature is detected during the start-up temperature control, the second electric power level is corrected to the necessary electric power in consideration of the heat accumulating degree of the fixing apparatus on the basis of the detection temperature of the thermistor abutting against the heater holder 17, whereby more stable temperature control can be achieved without generating the overshoot.

Figure 17:
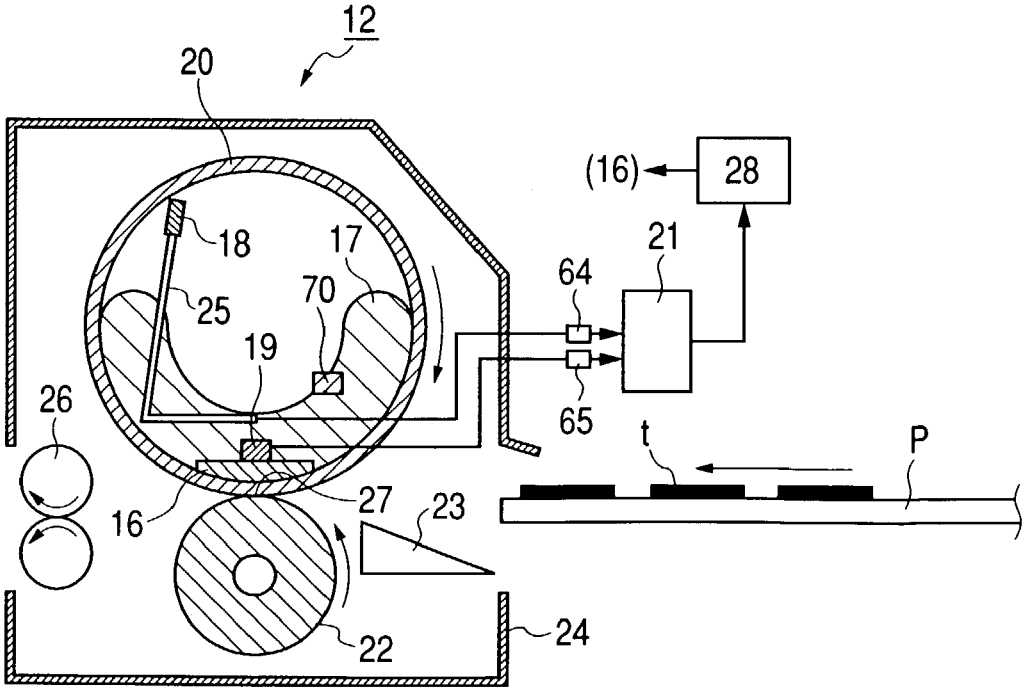
FIG. 17 is a schematic sectional view of a fixing apparatus according to a seventh embodiment of the present invention.

In this embodiment, general construction and control of a fixing apparatus are similar to those in the fifth embodiment. However, as shown in FIG. 17, a third thermistor 79 as third temperature detecting means is disposed within the heater holder 17. The seventh embodiment differs from the first embodiment in the point that, when the electric power applied to the fixing heater 16 is corrected, the electric power is corrected to the substantially necessary electric power in consideration of the heat accumulating degree of the fixing apparatus by utilizing the third thermistor 70.

A construction of an image forming apparatus is similar to that in the first embodiment and is as shown in FIG. 1.

Further, a construction of a fixing apparatus is as shown in FIGS. 2, 3 and 4A to 4C, and duplicate explanation will be omitted.

In this embodiment, when the heat accumulating degree of the fixing apparatus is considered, the heat accumulating degree is directly measured by using the third thermistor 70 abutting against the heater holder 17.

By doing so, the heat accumulating degree of the fixing apparatus can be sought more precisely.

FIG. 16 is a graph showing a relationship between the temperature of the heater holder 17 and the electric power value required for maintaining the temperature of the fixing apparatus. As such, the heater holder and the electric power value required for maintaining the temperature of the fixing apparatus represent a relationship as shown in FIG. 7 in a reproducible manner.

By using the predetermined electric power determined from the detection temperature of the third thermistor 70 by linear interpolation, the necessary electric power can be sought further accurately.

Since the effect obtained by using this embodiment is, in principle, the same as that of the sixth embodiment, explanation thereof will be omitted. However, in this embodiment, since the value of the second electric power level applied upon the start-up can be determined further accurately in fixing apparatuses having various conditions from the fixing apparatus at the room temperature to the well warmed fixing apparatus, very stable start-up temperature control can be achieved.

In this way, the stable start-up temperature control (temperature ripple is within about 7° C.) could be achieved regardless of the heat accumulating degree of the fixing apparatus.

As such, by suppressing the overshoot and the temperature ripple due to the overshoot, the service life of the fixing apparatus can be extended, and, the correct temperature control of the fixing member is performed, with the result that the good fixing ability can be obtained, whereby a high quality image which does not generate a poor image that would be caused if the fixing temperature control temperature is improper and in which there is no unevenness of printing quality such as gloss can be obtained.

<Others>

1) In this way, in the above-mentioned first to fourth embodiments, an example that the process speed is 87 mm/sec, the print speed is 16 sheets per minute, the temperature control temperature is 190° C. and the time period for applying the predetermined electric power is about 1.5 second from about 0.5 second before the recording material rushing upon starting of the sheet passing was explained. However, depending upon the kind of the recording material and/or image quality of an image desired to be obtained or depending upon a condition for obtaining better fixing ability, the process speed, print speed and/or temperature control temperature may be set to other values. Also in such a case, by applying the present invention, high accurate temperature control in which the temperature change is small can be achieved and similar effect can be obtained. In this case, it should be noted that the value of the corrected predetermined electric power and the time period for applying the predetermined electric power are varied with the process speed, print speed and/or temperature control temperature.

2) Further, in the above-mentioned embodiments, an example that the PID control is fundamentally used as the electric power control for performing the temperature control was explained. This control is used as a controlling method in which the temperature is approached to the target temperature quickly and which is strong in external disturbance. Thus, P control, PI control or other feedback control can be used for performing the temperature control and the similar effect can be obtained.

3) Further, in the above-mentioned first to seventh embodiments, an example that the paper mode, media sensor or environmental sensor is used in order to determine the value of the predetermined electric value in consideration of the heat capacity of the recording material and the difference in heat transfer characteristics from the fixing apparatus was explained. However, by using a method for directly measuring the heat capacity of the recording material and the difference in heat transfer characteristics from the fixing apparatus before the recording material actually rushes into the fixing apparatus and by reflecting the measured result upon the value of the predetermined electric power, the present invention can be applied so that the similar or further accurate (regarding the temperature control) temperature control can be achieved.

4) Further, in the above-mentioned first to fourth embodiments, an example that the print sheet number of the fixing apparatus or the temperature of the sub thermistor 19 upon starting of the electric power dispatching is used in order to determine the value of the predetermined electric power in consideration of the heat accumulating degree of the fixing apparatus was explained. However, also by using a method for directly measuring the heat accumulating degree of the fixing apparatus by actually adding a new thermistor onto the heater holder 17 or the pressurizing roller 22, for example, within the fixing apparatus, the present invention can be applied so that the similar or further accurate (regarding the temperature control) temperature control can be achieved.

5) Further, in the above-mentioned fifth to seventh embodiments, an example that the process speed is 87 mm/sec, the temperature control temperature is 190° C. and the time period for applying the predetermined electric power is about 1.5 second after the detection temperature of the main thermistor 18 becomes 170° C. (target temperature −20° C.) was explained. However, depending upon the kind of the recording material and/or image quality of an image desired to be obtained or depending upon a condition for obtaining better fixing ability, even when the process speed, print speed and/or temperature control temperature are set to other values, by applying the present invention, high accurate temperature control in which the temperature change is small can be achieved and similar effect can be obtained. In this case, it should be noted that the value of the corrected predetermined electric power and the time period for applying the predetermined electric power are varied with the process speed, print speed and/or temperature control temperature.

6) Further, in the above-mentioned fifth to seventh embodiments, although the start-up control was explained as the two stage controls, three or more stage controls may be used. In this case, more accurate control such as setting of the electric power value can be achieved and more stable temperature control can be achieved.

7) Further, in the above-mentioned embodiments, although the control for correcting the electric power applied to the fixing heater 16 to the predetermined electric power required for the fixing apparatus suitable for specific condition was explained, as a method for falsely achieving this control, the target temperature upon the temperature control may be changed temporarily and the target temperature mat be changed so that the electric power applied to the fixing heater 16 eventually becomes the predetermined electric power required for the fixing apparatus. Namely, a controlling method in which, in the above-mentioned first to fourth embodiments, the target temperature of the main thermistor 18 or the sub thermistor 19 is set to a temperature higher than the temperature before the recording material P rushing for about 1 second before about 0.5 second until the recording material P rushes into the fixing nip portion, so that the electric power required for maintaining the fixing apparatus to the predetermined temperature is eventually applied or a controlling method in which, in the above-mentioned fifth to seventh embodiments, after the detection temperature of the main thermistor 18 reaches 170° C. (target temperature −20° C.), the target temperature is set to a higher value for about 1.5 second, so that the electric power required for maintaining the fixing apparatus to the predetermined temperature is eventually applied may be used and the similar effect can be obtained.

8) Further, in the above-mentioned embodiments, an example that the first temperature detecting means of the fixing apparatus are disposed at the position different from the heating element was explained. However, even when the first temperature detecting means are disposed on the heating element, for example, also in a case where the first temperature detecting means are situated at a position different from the heat generating area or in a case where the response of the temperature detecting means is slow, the similar effect can be obtained.

9) Further, in the above-mentioned embodiments, the fixing apparatus in which the heat capacity of the fixing belt 20 is at least from $4.2\times10^{-2}$ J/cm$^{2}$·° C. to 4.2 J/cm$^{2}$·° C. was explained. The reason is that, if the heat capacity of the fixing belt 20 is equal to or smaller than $4.2\times10^{-2}$ J/cm$^{2}$·° C., the on-demand property is worsened, and, if the heat capacity of the fixing belt 20 is equal to or greater than 4.2 J/cm$^{2}$·° C., the thickness of the elastic layer of the fixing belt 20 cannot be maintained sufficiently, with the result that a poor image such as gloss unevenness is generated. However, the present invention can be applied to a fixing apparatus including a fixing belt having heat capacity other than the above-mentioned heat capacity and the similar effect can be obtained.

10) Further, in the embodiments of the present invention, the fixing apparatus in which the fixing belt 20 has the elastic layer was explained. However, so long as a fixing apparatus in which the fixing member has the heat capacity as explained in the embodiments is used, the elastic layer may be or may not be provided.

11) Further, the fixing apparatus in which the ceramic heater as the heating member constituted by the resistive heating element formed on the ceramic substrate is used was explained. The reason is that the ceramic heater is used as a heating member used in a low cost color on-demand fixing apparatus. A halogen lamp or an electromagnetic induction heating member can be used as the heating member and the similar effect can be obtained.

12) Further, The first fixing member and the second fixing member defining the fixing nip portion therebetween is not limited to the fixing belt and the pressurizing roller shown in the first to seventh embodiments. An apparatus in which both of the first fixing member and the second fixing member include heating members (heat sources) may be used.

13) Further, the heating member is not necessarily disposed at the fixing nip portion 27. For example, the heat source may be disposed at an upstream side or at a downstream side of the fixing nip portion 27 in the shifting direction of the fixing belt.

14) Further, in the embodiments, although the fixing apparatus was of pressurizing rotary member driving type, a fixing apparatus in which a driving roller is provided on an inner peripheral surface of an endless fixing belt to drive the fixing belt while applying tension on the fixing belt may be used.

15) Further, the fixing apparatus according to the present invention may include not only a fixing apparatus for thermally fixing the unfixed image onto the recording material as the permanent image but also an image heating apparatus for falsely fixing an unfixed image onto a recording material or an image heating apparatus which improves an imaged surface property such as gloss by re-heating a recording material bearing an image.

16) Further, The image forming system of the image forming apparatus is not limited to the electro-photographic system, but an electrostatic recording system or a magnetic recording system may be used and the image forming system may be of transferring type or direct type.

What is claimed is:

1. A fixing apparatus comprising:

a first rotary member and a second rotary member, for nipping and conveying a recording material, said first rotary member having a belt-shaped member;

a supporting member which slidably supports the first rotary member;

a heating element for heating the first rotary member, whereby an image on the recording material nipped and conveyed at said nip portion is heat-fixed;

an electric power supplying portion for supplying an electric power to said heating element;

a temperature detecting element for detecting a temperature of the first rotary member, said temperature detecting element being out of contact with said supporting member and arranged at a position where a portion of the first rotary member at which is in said nip portion reaches when the first rotary member rotates by a predetermined angle; and a controller for controlling a temperature of said first rotary member by performing feedback control of the electric power supplied from said electric power supplying portion to said heating element on the basis of a temperature detected by said temperature detecting element, wherein said controller increases an amount of the electric power supplied to said heating element substantially at a timing when a temperature change of said nip portion caused by conveying of the recording material into said nip portion will be reduced without depending on a detection of a temperature change caused by conveying of the recording material into said nip portion by said temperature detecting element.

2. A fixing apparatus according to claim 1, wherein a temperature detection position of said temperature detecting element is an inner surface of the first rotary member.

3. A fixing apparatus according to claim 1, wherein a value of a predetermined electric power is substantially the same as an electric power value required after the recording material is conveyed into said nip portion.

4. A fixing apparatus according to claim 1, wherein, while said controller controls an electric power supplied to said heating element so that a temperature change of the nip portion caused by conveying of the recording material into said nip portion is reduced, the feedback control is not performed.

5. A fixing apparatus according to claim 1, wherein said controller controls the electric power supplied to said heating element so that temperature change of said nip portion caused by conveying of the recording material into said nip portion is reduced by changing a target temperature.

6. A fixing apparatus according to claim 1, wherein, when said temperature detecting element is used as a first temperature detecting element, a second temperature detecting element is further provided other than said first temperature detecting element, a temperature detection position of said second temperature detecting element is a position nearer a heating area of said heating element than said first temperature detecting element, and wherein said controller controls a temperature of said first rotary member by performing feedback control of the electric power to said heating element on the basis of a temperature detected by said second temperature detecting element so that temperature change of said nip portion caused by conveying of the recording material into said nip portion is reduced, before temperature change caused by conveying of the recording material into said nip portion is detected by said second temperature detecting element.

7. A fixing apparatus according to claim 1, wherein said controller controls the electric power supplied to said heating element so that temperature change of said nip portion caused by conveying of the recording material into said nip portion is reduced according to a heat accumulating degree of said fixing apparatus.

8. A fixing apparatus according to claim 7, wherein, when said temperature detecting element is used as a first temperature detecting element a second temperature detecting element is further provided other than said first temperature detecting element, a temperature detection position of said second temperature detecting element is a position nearer said heating element than that of said first temperature detecting element and, said controller controls the electric power supplied to said heating element so that temperature change of said nip portion caused by conveying of the recording material into said nip portion is reduced, according to the heat accumulating degree of said fixing apparatus represented by a detection temperature of said second temperature detecting element, before said fixing apparatus is started-up upon starting of an image forming operation.

9. A fixing apparatus according to claim 1, wherein said controller controls the electric power supplied to said heating element so that temperature change of said nip portion caused by conveying of the recording material into said nip portion is reduced, according to a print sheet number of said fixing apparatus.

10. A fixing apparatus according to claim 1, wherein said controller controls the electric power supplied to said heating element so that temperature change of said nip portion caused by conveying of the recording material into said nip portion is reduced, according to heat capacity of the recording material.

11. A fixing apparatus according to claim 1, wherein said controller controls the electric power supplied to said heating element so that temperature change of said nip portion caused by conveying of the recording material into said nip portion is reduced, according to a basis weight of the recording material.

12. A fixing apparatus according to claim 10, wherein said controller controls the electric power supplied to said heating element so that temperature change of said nip portion caused by conveying of the recording material into said nip portion is reduced, according to a corresponding to a kind of the recording material.

13. A fixing apparatus according to claim 10, wherein said controller controls the electric power supplied to said heating element so that temperature change of said nip portion caused by conveying of the recording material into said nip portion is reduced, according to a moisture absorbing degree of the recording material.

14. A fixing apparatus according to claim 1, wherein said controller controls the electric power supplied to said heating element so that temperature change of said nip portion caused by conveying of the recording material into said nip portion is reduced, according to heat transfer characteristics from said fixing apparatus to the recording material.

15. A fixing apparatus according to claim 14, wherein said controller controls the electric power supplied to said heating element so that temperature change of said nip portion caused by conveying of the recording material into said nip portion is reduced, according to heat transfer characteristics from said fixing apparatus in a case where the recording material is a rough paper.

16. A fixing apparatus according to claim 14, wherein said controller controls the electric power supplied to said heating element so that temperature change of said nip portion caused by conveying of the recording material into said nip portion is reduced, according to heat transfer characteristics from said fixing apparatus in a case where the recording material is a film.

17. A fixing apparatus according to claim 1, wherein heat capacity of said first rotary member is from $4.2\times10^{-2}$ J/cm$^{2}$·° C. to 4.2 J/cm$^{2}$·° C.

18. A fixing apparatus according to claim 1, wherein heat capacity of said first rotary member is from $8.82\times10^{-2}$ J/cm$^{2}$° C. to $18.9\times10^{-2}$ J/cm$^{2}$° C.

19. A fixing apparatus according to claim 1, wherein a fixing belt constituted by providing an elastic layer on a belt-shaped member is used as said first rotary member.

20. A fixing apparatus according to claim 19, wherein a base material of said fixing belt is heat-resistive resin.

21. A fixing apparatus according to claim 19, wherein a base material of said fixing belt is metal.

22. A fixing apparatus according to claim 19, wherein a mold releasing layer is provided as an outermost surface layer of said fixing belt.

23. A fixing apparatus according to claim 1, wherein a line-shaped heating element is used as said heating element.

24. A fixing apparatus according to claim 1, wherein a ceramic heater constituted by forming a resistive heating element on a ceramic substrate is used as said heating element.

25. A fixing apparatus according to claim 1, wherein a heating element holding member holding said heating element is made of resin material.

26. A fixing apparatus according to claim 25, wherein said heating element holding member is made of liquid crystal polymer.

27. An image forming apparatus wherein it mounts a fixing apparatus according to claim 1 thereon.

28. An image forming apparatus according to claim 27, wherein said image forming apparatus is a color image forming apparatus for forming a color image by superimposing plural color toner images.

29. A fixing apparatus according to claim 1, wherein said controller supplies an amount of electric power expected to be required after a recording material comes into said fixing apparatus so that decrease of temperature at a nip portion is alleviated by conveyance of the recording material to the nip portion.

30. A fixing apparatus according to claim 1, wherein the amount of the electric power increased is supplied to said heating element for a predetermined time.

31. A fixing apparatus according to claim 1, wherein said controller increases the electrical power to said heating element by varying a target temperature so that decrease of temperature at a nip portion is alleviated by conveyance of the recording material to the nip portion.

32. A fixing apparatus according to claim 1, further comprising:

second temperature detecting means provided near said heating element, wherein said controller increases the electrical power to said heating element by switching to a control based on a temperature detected said second temperature detecting means so that decrease of temperature at a nip portion is alleviated by conveyance of the recording material to the nip portion.

33. A fixing apparatus according to claim 1, wherein said controller comprises a time period to supply an electrical power to said heating element with an amount of a first level to prohibits the feed control and rapidly increase at least a fixing temperature when said fixing apparatus is started up at a starting time of printing; and with an amount of a second level to keep a temperature of said fixing apparatus stable.

34. A fixing apparatus according to claim 33, wherein said controller has means to determine the amount of a second level as a variable amount.

35. An image forming apparatus comprising a fixing apparatus according to claim 1.

36. An image forming apparatus according to claim 35, wherein the image forming apparatus is for forming a color image by superposing toner images with plural colors.

* * * * *

UNITED STATES PATENT AND TRADEMARK OFFICE

CERTIFICATE OF CORRECTION

PATENT NO. : 7,136,601 B2
APPLICATION NO. : 10/463528
DATED : November 14, 2006
INVENTOR(S) : Tomoo Akizuki et al.

It is certified that error appears in the above-identified patent and that said Letters Patent is hereby corrected as shown below:

COLUMN 2:
Line 39, “a” should read --an--.

COLUMN 4:
Line 36, “60°C.)” should read --6°C.)--.
Line 52, “difficult” should read --difficult to--.
Line 64, “FIG.,” should read --FIG. 6,--.

COLUMN 5:
Line 4, “nipple” should read --ripple--.
Line 10, “nipple” should read --ripple--.
Line 17, “control”;” should read --control)”;--.
Line 44, “nipple” should read --ripple--.

COLUMN 7:
Line 26, “chematic” should read --schematic--.

COLUMN 8:
Line 45, “DETAIELD” should read --DETAILED--.

COLUMN 9:
Line 3, “forming an” should read --forming a--.

COLUMN 11:
Line 5, “driving,” should read --driving--.

COLUMN 16:
Line 4, “$18.9x10^{-}2$” should read --$18.9x10^{-2}$--.
Line 27, “fir” should read --for--.

COLUMN 17:
Line 53, “(step a13)” should read --(step a13).--.

COLUMN 18:
Line 15, “IPD” should read --PID--.

COLUMN 21:
Line 7, “recoding” should read --recording--.

COLUMN 26:
Line 38, “there by” should read --thereby--.

UNITED STATES PATENT AND TRADEMARK OFFICE

CERTIFICATE OF CORRECTION

PATENT NO. : 7,136,601 B2
APPLICATION NO. : 10/463528
DATED : November 14, 2006
INVENTOR(S) : Tomoo Akizuki et al.

It is certified that error appears in the above-identified patent and that said Letters Patent is hereby corrected as shown below:

COLUMN 27:
Line 8, “is” should be deleted.

COLUMN 30:
Line 54, “is” should be deleted.

COLUMN 36:
Line 18, “lever” should read --level--.
Line 37, “lever” should read --level--.

COLUMN 37:
Line 34, “190°°C.” should read --190°C.--.

COLUMN 39:
Line 42, “cloths” should read --clothes--.

COLUMN 41:
Line 25, “lever” should read --level--.
Line 56, “lever” should read --level--.
Line 62, “is” should be deleted.

COLUMN 43:
Line 21, “lever” should read --level--.

COLUMN 44:
Line 3, “lever” should read --level--.
Line 48, “lever” should read --level--.

COLUMN 46:
Line 67, “mat” should read --may--.

COLUMN 47:
Line 58, “The” should read --the--.

COLUMN 48:
Line 18, “The” should read --the--.

COLUMN 50:
Line 35, “$J/cm^{20}C$. to $18.9x10^{-2}J/cm^{20}C$.” should read --$J/cm^{2.0}C$. to $18.9x10^{-2}J/cm^{2.0}C$.--.

UNITED STATES PATENT AND TRADEMARK OFFICE

CERTIFICATE OF CORRECTION

PATENT NO. : 7,136,601 B2
APPLICATION NO. : 10/463528
DATED : November 14, 2006
INVENTOR(S) : Tomoo Akizuki et al.

It is certified that error appears in the above-identified patent and that said Letters Patent is hereby corrected as shown below:

COLUMN 51:
Line 18, "detected" should read --detected by--.

COLUMN 52:
Line 6, "prohibits" should read --prohibit--.

Signed and Sealed this

Third Day of July, 2007

JON W. DUDAS
*Director of the United States Patent and Trademark Office*